US011850644B2

(12) United States Patent
Yamaguchi et al.

(10) Patent No.: US 11,850,644 B2
(45) Date of Patent: Dec. 26, 2023

(54) ZIGZAGGING CONTROL METHOD FOR WORKPIECE

(71) Applicant: NIPPON STEEL CORPORATION, Tokyo (JP)

(72) Inventors: Kazuma Yamaguchi, Tokyo (JP); Atsushi Ishii, Tokyo (JP); Daisuke Nikkuni, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 162 days.

(21) Appl. No.: 17/440,060

(22) PCT Filed: Apr. 10, 2020

(86) PCT No.: PCT/JP2020/016194

§ 371 (c)(1),
(2) Date: Sep. 16, 2021

(87) PCT Pub. No.: WO2020/213542

PCT Pub. Date: Oct. 22, 2020

(65) Prior Publication Data

US 2022/0184679 A1 Jun. 16, 2022

(30) Foreign Application Priority Data

Apr. 19, 2019 (JP) ..... 2019-080276

(51) Int. Cl.
*B21B 37/68* (2006.01)
*B21B 37/58* (2006.01)
(Continued)

(52) U.S. Cl.
CPC ..... *B21B 37/68* (2013.01); *B21B 37/58* (2013.01); *B21B 37/72* (2013.01); *B21B 38/08* (2013.01)

(58) Field of Classification Search
CPC ..... B21B 37/68; B21B 37/58; B21B 37/72; B21B 37/16; B21B 38/08; B21B 13/023; B21B 2265/12; B21B 2273/04; B21B 2265/20
See application file for complete search history.

(56) References Cited

U.S. PATENT DOCUMENTS 5,666,837 A * 9/1997 Kajiwara ..... B21B 13/023 72/236
6,401,506 B1 * 6/2002 Ogawa ..... B21B 37/68 72/247
2019/0381548 A1 12/2019 Ishii et al.

FOREIGN PATENT DOCUMENTS

EP 1 344 582 A1 9/2003
JP 11-47814 A 2/1999
(Continued)

OTHER PUBLICATIONS

English translate (JP6212732B2), retrieved date Apr. 20, 2023.*
(Continued)

*Primary Examiner* — Matthew Katcoff
*Assistant Examiner* — Mohammed S. Alawadi
(74) *Attorney, Agent, or Firm* — Birch, Stewart, Kolasch & Birch, LLP

(57) ABSTRACT

There is provided a zigzagging control method for a workpiece including: an estimation step of, before rolling of a tail portion of the workpiece, acquiring at least any one of an inter-roll thrust force estimated based on an inter-roll cross angle and an inter-roll friction coefficient and a material-roll thrust force estimated based on a material-roll cross angle and a material-roll friction coefficient; and a tail control step of, during the rolling of the tail portion of the workpiece, measuring work-side and drive-side rolling loads, correcting a rolling load difference or a rolling load difference ratio based on any two of acquired parameters including a roll-axis-direction thrust counterforce at the measurement of the rolling loads, the inter-roll thrust force, and the material-roll
(Continued)

thrust force, and performing reduction leveling control on a rolling mill based on the corrected rolling load difference or rolling load difference ratio.

20 Claims, 10 Drawing Sheets

(51) Int. Cl.
*B21B 37/72* (2006.01)
*B21B 38/08* (2006.01)

(56) References Cited

FOREIGN PATENT DOCUMENTS

| | | | | |
|---|---|---|---|---|
| JP | 2000-312911 | A | | 11/2000 |
| JP | 2005-976 | A | | 1/2005 |
| JP | 2009-178754 | A | | 8/2009 |
| JP | 2014-4599 | A | | 1/2014 |
| JP | 6212732 | B2 | * | 10/2017 |
| WO | WO 2018/163930 | A1 | | 9/2018 |

OTHER PUBLICATIONS

Liu et al., "Investigation of Hot Strip Mill 4 Hi Reversing Roughing Mill Main Drive Motor Thrust Bearing Damage", AISTech 2009 Proceedings—vol. II, 2009, pp. 1091-1101.

* cited by examiner

ZIGZAGGING CONTROL METHOD FOR WORKPIECE

TECHNICAL FIELD

The present invention relates to a zigzagging control method for a workpiece.

BACKGROUND ART

When a workpiece is rolled with a rolling mill, the workpiece may cause what is called zigzagging, in which a width-direction center of the workpiece deviates from a mill center while a tail portion of the workpiece is passing through the rolling mill. If a workpiece zigzags, a tail portion of the workpiece may hit a side guide that is placed downstream of a rolling mill through which the workpiece passes; in this case, buckling can occur, in which the workpiece is rolled with a next rolling mill as the workpiece is buckled. The occurrence of buckling of a workpiece causes an excessively heavy rolling load on the rolling mill, which may result in damage to a roll and, in addition, suspension of operation for repair.

Hence, techniques have been proposed for preventing zigzagging of a workpiece when a tail portion of the workpiece passes a rolling mill. For example, Patent Document 1 discloses a differential-load type zigzagging control method in which roll-axis-direction thrust counterforces of all of at least either upper rolls or lower rolls other than backup rolls are measured, and an influence of an inter-roll thrust force on a differential load is taken into consideration. Patent Document 2 discloses a differential-load type zigzagging control method in which a work-roll thrust counterforce and a surface profile of a work roll are measured, and influences of an inter-roll thrust force and a material-roll thrust force on a differential load are taken into consideration. Patent Document 3 discloses a differential-load type zigzagging control method in which a skew angle of a roll is measured, and an influence of an inter-roll thrust force on a differential load is taken into consideration. Patent Document 4 discloses a method for controlling a rolling mill in which, before rolling, a roll gap is opened, and a bending force is applied while rollers are driven to identify an influence of an inter-roll thrust force on a differential load, and reduction leveling control is performed with consideration given to the influence of the inter-roll thrust force on the differential load.

LIST OF PRIOR ART DOCUMENTS

Patent Document

Patent Document 1: JP2000-312911A
Patent Document 2: JP2005-976A
Patent Document 3: JP2014-4599A
Patent Document 4: JP2009-178754A

Non Patent Document

Non Patent Document 1: Y. Liu et al. "Investigation of Hot Strip Mill 4 Hi Reversing Roughing Mill Main Drive Motor Thrust Bearing Damage", AISTech 2009 Proceedings-Volume II, 2009, p.1091-1101

SUMMARY OF INVENTION

Technical Problem

Here, in the conventional differential-load type zigzagging control, work-side and drive-side rolling loads of at least any one of upper and lower roll assemblies are measured to determine a rolling load difference or a rolling load difference ratio, and reduction leveling control is performed on a rolling mill based on this value. However, it is known that if inter-roll cross (a rotation tilt in a horizontal plane) occurs, an axial force between rolls (inter-roll thrust force) is generated. In addition, if material-roll cross occurs, an axial force between a material and a roll (material-roll thrust force) is similarly generated. The material-roll thrust force is small when compared with the inter-roll thrust force but has a significant influence particularly in a case of a low rolling reduction rate. These inter-roll thrust force and material-roll thrust force are supported by counterforces from roll chocks, which causes an overturning moment to act on a roll due to a perpendicular distance between a support point and a line of action of the force (moment arm). Note that the overturning moment of a roll refers to a moment in a plane perpendicular to a longitudinal direction of rolling. It is considered that a difference in vertical direction load cell measured value between the work side and the drive side (differential load) fluctuates at this time so as to establish the balance with the overturning moment. If a differential load attributable to these thrust forces occurs unintentionally, the differential load serves as a disturbance in the reduction leveling control, which becomes a cause of decreasing accuracy of leveling correction.

In the techniques described in the above Patent Documents 1, 3, and 4, no consideration is given to an inference of a material-roll thrust force on a differential load; therefore, a differential load attributable to thrust forces cannot be estimated accurately, and thus accurate leveling correction as described above cannot be performed. In the technique described in the above Patent Document 2, influence coefficients of an inter-roll thrust force and a material-roll thrust force on a differential load are calculated, and a sum of the influence coefficients is multiplied by a measured thrust counterforce to estimate a differential load attributable to thrust forces, by which reduction leveling control is performed. However, this technique lacks the number of parameters to determine the influence coefficients, and thus an accuracy of the estimation is not satisfactory. For this reason, as with the above Patent Documents 1, 3, and 4, accurate leveling correction cannot be performed.

In the technique described in the above Patent Document 4, it is necessary before rolling to open a roll gap and apply a bending force while rollers are driven to identify an influence of an inter-roll thrust force on a differential load, and this operation is required to be performed in addition to a regular operation.

The present invention is made in view of the problems described above and has an objective to provide a novel, improved zigzagging control method for a workpiece that enables leveling correction to be performed with an influence of thrust forces on a differential load taken into consideration more accurately.

Solution to Problem

In order to solve the problem described above, according to an aspect of the present invention, there is provided a zigzagging control method for a workpiece in a rolling mill of four-high or more, the rolling mill including a plurality of rolls that include at least a pair of work rolls and at least a pair of backup rolls supporting the work rolls, an upper roll assembly including an upper work roll and an upper backup roll, a lower roll assembly including a lower work roll and a lower backup roll, the zigzagging control method including: an estimation step of acquiring at least any one of an inter-roll thrust force estimated based on an inter-roll cross angle and an inter-roll friction coefficient that are acquired through measurement or estimation and a material-roll thrust force estimated based on a material-roll cross angle and a material-roll friction coefficient that are acquired through measurement or estimation, the estimation step being performed before rolling of a tail portion of the workpiece; and a tail control step of measuring work-side and drive-side rolling loads of at least any one of the upper and lower roll assemblies, correcting rolling-load-difference information based on any two of acquired parameters including a roll-axis-direction thrust counterforce at the measurement of the rolling loads, the inter-roll thrust force, and the material-roll thrust force that act on a roll other than the backup roll, the rolling-load-difference information being calculated based on the measured work-side and drive-side rolling loads, and performing reduction leveling control on the rolling mill based on the corrected rolling-load-difference information, the tail control step being performed during the rolling of the tail portion of the workpiece.

In the tail control step, the rolling-load-difference information may be corrected based on the roll-axis-direction thrust counterforce measured at the measurement of the rolling loads and the inter-roll thrust force or the material-roll thrust force acquired in the estimation step.

In the estimation step, the inter-roll cross angle, the material-roll cross angle, the inter-roll friction coefficient, and the material-roll friction coefficient may be acquired through estimation based on rolling loads, rolling reduction rates, and thrust counterforces acting on the roll other than the backup roll at four levels or more acquired from at least any one of the upper and lower roll assemblies, and at least any one of the inter-roll thrust force and the material-roll thrust force may be acquired through estimation based on the acquired inter-roll cross angle, material-roll cross angle, inter-roll friction coefficient, and material-roll friction coefficient.

Alternatively, in the estimation step, the inter-roll friction coefficient and the material-roll friction coefficient may be acquired through measurement, the inter-roll cross angle and the material-roll cross angle may be acquired through estimation based on rolling loads, rolling reduction rates, and thrust counterforces acting on the roll other than the backup roll at two levels or more acquired from at least any one of the upper and lower roll assemblies, and at least any one of the inter-roll thrust force and the material-roll thrust force may be acquired through estimation based on the acquired inter-roll cross angle, material-roll cross angle, inter-roll friction coefficient, and material-roll friction coefficient.

Alternatively, in the estimation step, the inter-roll cross angle and the material-roll cross angle may be acquired through measurement, the inter-roll friction coefficient and the material-roll friction coefficient may be acquired through estimation based on rolling loads, rolling reduction rates, and thrust counterforces acting on the roll other than the backup roll at two levels or more acquired from at least any one of the upper and lower roll assemblies, and at least any one of the inter-roll thrust force and the material-roll thrust force may be acquired through estimation based on the acquired inter-roll cross angle, material-roll cross angle, inter-roll friction coefficient, and material-roll friction coefficient.

In the estimation step described above, estimated values, which are acquired through estimation out of the inter-roll cross angle, the material-roll cross angle, the inter-roll friction coefficient, and the material-roll friction coefficient, may be acquired in accordance with predicted values of variations of the estimated values of each workpiece estimated based on a result of past learning and a result of estimating estimated values in last rolling.

In the estimation step, estimated values, which are acquired through estimation out of the inter-roll cross angle, the material-roll cross angle, the inter-roll friction coefficient, and the material-roll friction coefficient, may be corrected in accordance with a difference between an estimated value based on data on constant portions of workpieces rolled in a past and an estimated value based on data on tail portions of the workpieces.

In the estimation step, rolling loads, rolling reduction rates, and thrust counterforces acting on a roll other than the backup roll for workpieces rolled recently may be used.

Alternately, in the estimation step, the inter-roll friction coefficient, the material-roll friction coefficient, the inter-roll cross angle, and the material-roll cross angle may be acquired through measurement, and at least any one of the inter-roll thrust force and the material-roll thrust force may be acquired through estimation based on the acquired inter-roll cross angle, material-roll cross angle, inter-roll friction coefficient, and material-roll friction coefficient.

Advantageous Effects of Invention

As described above, according to the present invention, leveling correction can be performed with an influence of the thrust forces on the differential load taken into consideration more accurately.

DESCRIPTION OF EMBODIMENT

Figure 1:
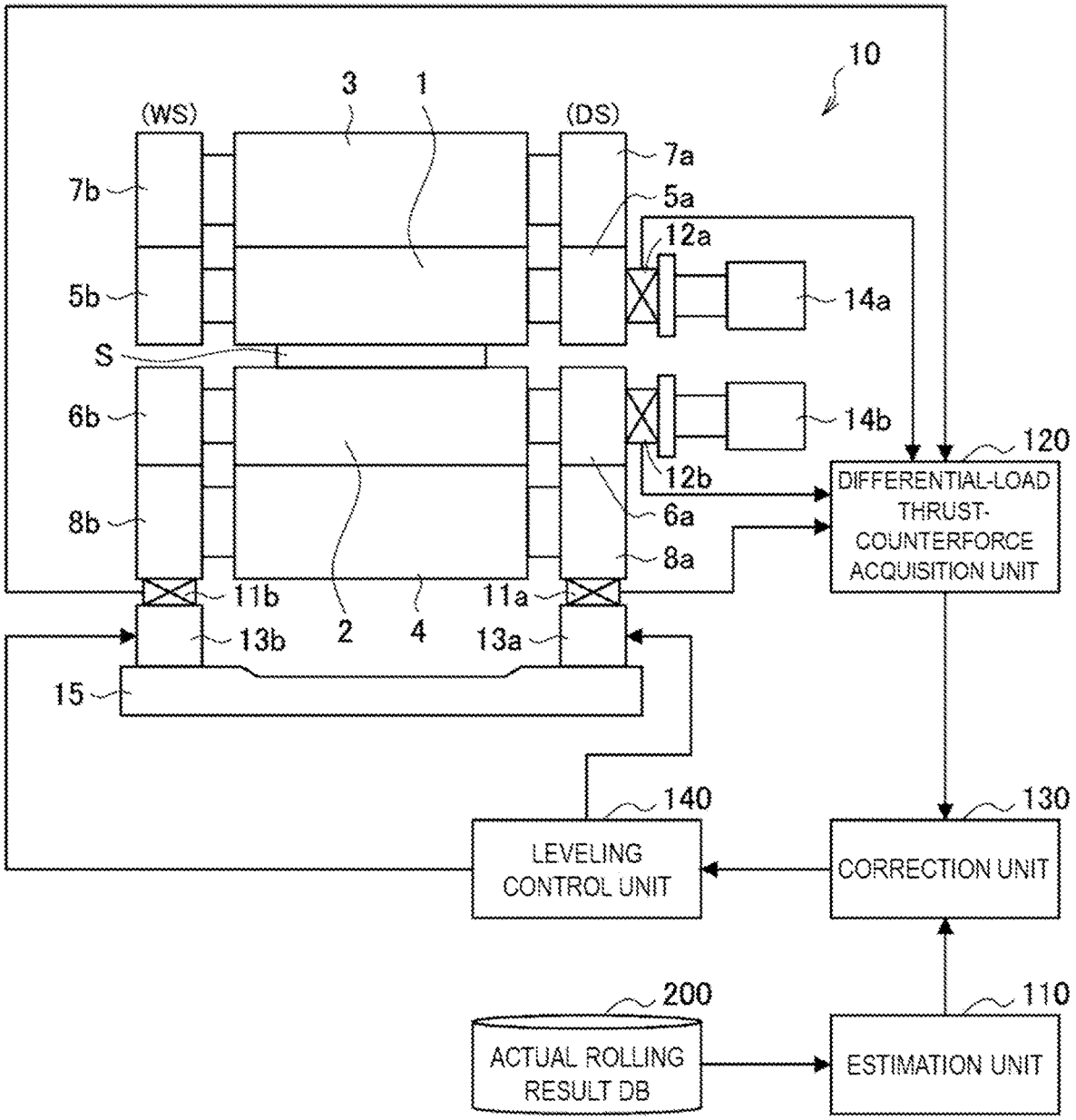
FIG. 1 is an explanatory diagram illustrating a configuration example of a four-high rolling mill and a processing device for performing zigzagging control on a workpiece according to an embodiment of the present invention.

A preferred embodiment of the present invention will be described below in detail with reference to the accompanying drawings. In the present specification and drawings, components having substantially the same functions and structures are denoted by the same reference characters, and the repeated description thereof will be omitted.

[1. Configuration of Rolling Mill]

First, a schematic configuration of a rolling mill to which a zigzagging control method for a workpiece according to an embodiment of the present invention is applied will be described with reference to FIG. 1. FIG. 1 is an explanatory diagram illustrating a configuration example of a four-high rolling mill and a processing device for performing zigzagging control on a workpiece S according to the present embodiment. Although FIG. 1 illustrates a four-high rolling mill, the present invention is applicable to a rolling mill of four-high or more with a plurality of rolls including at least a pair of work rolls and at least a pair of backup rolls supporting the work rolls. In FIG. 1, in a roll-axis direction, a work side is denoted as WS, and a drive side is denoted as DS. The work side is an operation side and is opposite to the drive side across the rolling mill.

A rolling mill 10 illustrated in FIG. 1 is a four-high rolling mill that includes a pair of work rolls 1 and 2 and a pair of backup rolls 3 and 4 supporting the work rolls 1 and 2. The upper work roll 1 is supported by upper work roll chocks 5*a* and 5*b*, and the lower work roll 2 is supported by lower work roll chocks 6*a* and 6*b*. The upper backup roll 3 is supported by upper backup roll chocks 7*a* and 7*b*, and the lower backup roll 4 is supported by lower backup roll chocks 8*a* and 8*b*. The upper work roll 1 and the upper backup roll 3 form an upper roll assembly, and the lower work roll 2 and the lower backup roll 4 form a lower roll assembly. The upper backup roll chocks 7*a* and 7*b*, and the lower backup roll chocks 8*a* and 8*b* are held by a housing 15.

The rolling mill 10 illustrated in FIG. 1 includes lower load sensors 11*a* and 11*b* each of which senses a vertical roll load relating to the lower roll assembly. The rolling mill 10 may include, in place of the lower load sensors 11*a* and 11*b*, upper load sensors each of which senses a vertical roll load relating to the upper roll assembly or may include the upper load sensors together with the lower load sensors 11*a* and 11*b*. The lower load sensor 11*a* senses a vertical roll load (rolling load) on the drive side, and the lower load sensor 11*b* senses a vertical roll load (rolling load) on the work side.

Below the lower load sensors 11*a* and 11*b*, leveling devices 13*a* and 13*b* that apply perpendicularly upward loads to the lower backup roll chocks 8*a* and 8*b*, respectively, are provided. The leveling devices 13*a* and 13*b* are each constituted by, for example, a hydraulic cylinder and can adjust leveling by moving their hydraulic cylinders in a perpendicular direction.

In addition, thrust counterforce measurement apparatuses 12*a* and 12*b* that measure roll-axis-direction thrust counterforces are installed on the work rolls 1 and 2 of the rolling mill 10, respectively. In the rolling mill 10 illustrated in FIG. 1, the thrust counterforce measurement apparatus 12*a* is provided between the upper work roll chock 5*a* on the work side and the work roll shift device 14*a*, and the thrust counterforce measurement apparatus 12*b* is provided between the lower work roll chock 6*a* on the work side and the work roll shift device 14*b*. The work roll shift devices 14*a* and 14*b* are driving devices for moving the work rolls 1 and 2 in the roll-axis direction, support the upper work roll chock 5*a* and the lower work roll chock 6*a*, respectively, and generate counterforces (roll-axis-direction thrust counterforces) that support the inter-roll thrust force and the material-roll thrust force. The roll-axis-direction thrust counterforces measured by the thrust counterforce measurement apparatuses 12*a* and 12*b* are output to a differential-load thrust-counterforce acquisition unit 120.

The rolling mill 10 according to the present embodiment includes, as illustrated in FIG. 1, an estimation unit 110, the differential-load thrust-counterforce acquisition unit 120, a correction unit 130, and a leveling control unit 140, as a device that performs information processing for performing reduction leveling control by the leveling devices 13*a* and 13*b*. The processing device having these functional units may be constituted by generic members and circuits or may be constituted by pieces of hardware that are specialized in the functions of the constituent components. Alternatively, the functions of the constituent components of the processing device may be all fulfilled by a CPU or the like. A configuration used for the processing device can be altered as appropriate in accordance with a technological standard of a time at which the present embodiment is carried out. In addition, a computer program for implementing the functions of the processing device can be fabricated and installed in a personal computer or the like. In addition, a computer-readable recording medium that stores such a computer program can be also provided. The computer program may be distributed, for example, over a network without using a recording medium.

The estimation unit 110 estimates at least any one of an inter-roll thrust force and a material-roll thrust force generated in the rolling mill before a tail portion of the workpiece S is rolled. The estimation unit 110 calculates an inter-roll cross angle, a material-roll cross angle, an inter-roll friction coefficient, and a material-roll friction coefficient based on rolling loads, rolling reduction rates, and thrust counterforces acting on a roll other than the backup roll at four levels or more acquired from at least any one of the upper and lower roll assemblies and calculates at least any one of the inter-roll thrust force and the material-roll thrust force. As the rolling loads, the rolling reduction rates, and the thrust counterforces acting on the roll other than the backup roll at four levels or more used by the estimation unit 110, actual rolling result data stored in an actual rolling result database 200 may be used.

The differential-load thrust-counterforce acquisition unit 120 acquires a drive-side rolling load sensed by the lower load sensor 11*a* and a work-side rolling load sensed by the lower load sensor 11*b* and calculates a rolling load difference or a rolling load difference ratio as rolling-load-difference information. The rolling load difference is a difference between the drive-side rolling load and the work-side rolling load, and the rolling load difference ratio is a ratio of the load difference to a total load (i.e., a sum of the drive-side rolling load and the work-side rolling load) (load difference/total load). The rolling load difference ratio enables elimination of a sensing error attributable to a difference in characteristics between right and left load sensors. With the same centerline deviation, the sensed rolling load difference ratio does not fluctuate if the rolling loads fluctuate due to changes in temperature, sheet width, sheet thickness, and the like. Therefore, by using the rolling load difference ratio, a centerline deviation can be corrected more accurately as compared with a case of using the rolling load difference.

The correction unit 130 corrects the rolling load difference or the rolling load difference ratio calculated by the differential-load thrust-counterforce acquisition unit 120 based on the measured roll-axis-direction thrust counterforces and the inter-roll thrust force or the material-roll thrust force calculated by the estimation unit 110. This removes a rolling load difference or a rolling load difference ratio attributable to the thrust forces from a rolling load difference or a rolling load difference ratio used in the reduction leveling control.

The leveling control unit 140 controls the leveling devices 13*a* and 13*b*. The leveling control unit 140 performs the reduction leveling control using the rolling load difference or the rolling load difference ratio corrected by the correction unit 130. The reduction leveling control can be performed by using a well-known method such as reduction leveling control described in Patent Document 1 described above.

[2. Calculation of Rolling Load Difference Attributable to Thrust Forces]

In the zigzagging control method for a workpiece according to the present embodiment, the reduction leveling control is performed with a rolling load difference or a rolling load difference ratio from which a component attributable to the thrust forces serving as disturbance is removed. To take the load difference attributable to the thrust forces into consideration for such reduction leveling control, it is necessary to acquire two or more values of the inter-roll thrust force, the material-roll thrust force, and the roll-axis-direction thrust counterforce acting on the work roll through measurement or estimation. Of these, the roll-axis-direction thrust counterforce is measurable. In contrast, the inter-roll thrust force and the material-roll thrust force cannot be measured, and thus it is necessary to acquire at least any one of them through estimation. To do so, it is necessary to acquire the inter-roll cross angle, the material-roll cross angle, the inter-roll friction coefficient, and the material-roll friction coefficient through measurement or estimation.

Figure 2:
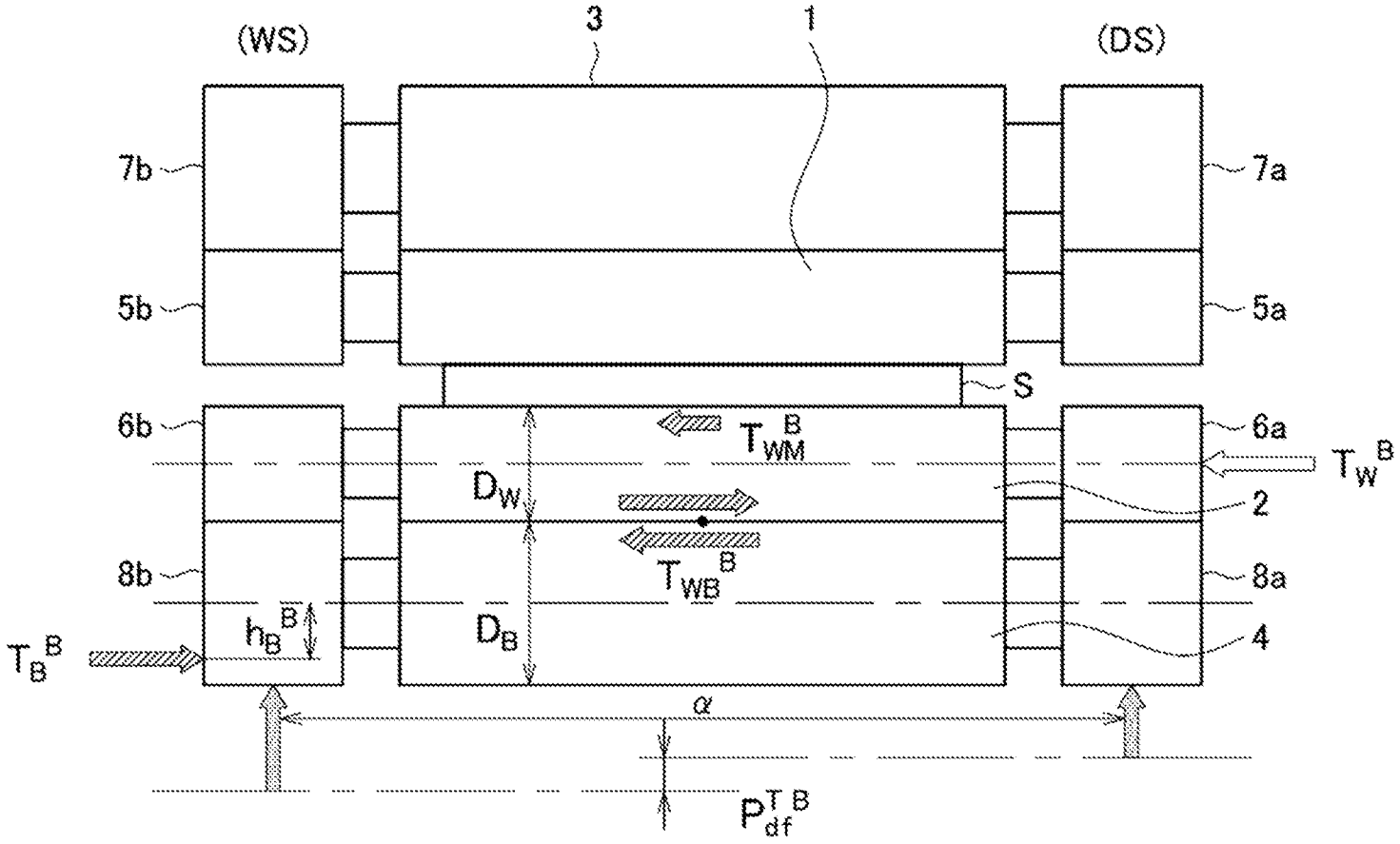
FIG. 2 is a schematic diagram illustrating forces that act in a rolling mill illustrated in FIG. 1.

Hereinafter, a method for calculating the rolling load difference attributable to the thrust forces in accordance with patterns of acquiring the material-roll cross angle, the inter-roll cross angle, the material-roll friction coefficient, and the inter-roll friction coefficient will be described in detail with reference to FIG. 2. FIG. 2 is a schematic diagram illustrating forces that act in the rolling mill 10 illustrated in FIG. 1. Although FIG. 2 illustrates only forces that act in the lower roll assembly, the description holds true for the upper roll assembly.

A material-roll friction coefficient $\mu_{WM}$, an inter-roll friction coefficient $\mu_{WB}$, a material-roll cross angle $\phi_{WM}$, and an inter-roll cross angle $\phi_{WB}$ are acquired through estimation or measurement. Specifically, 16 cases shown in Table 1 below are possible. Table 1 also shows formulas for determining a material-roll thrust force $T_{WM}^{B}$, an inter-roll thrust force $T_{WB}^{B}$, and a thrust counterforce $T_{W}^{B}$ acting on the lower work roll chocks 6*a* and 6*b*.

TABLE 1

| Case | $\mu_{WM}$ | $\mu_{WB}$ | $\phi_{WM}$ | $\phi_{WB}$ | $T_{WM}^{B}$ | $T_{WB}^{B}$ | $T_{W}^{B}$ |
|---|---|---|---|---|---|---|---|
| 1 | ● | ● | ● | ● | Formula(5a) | Formula(6a) | Formula(7a) |
| 2 | ○ | ● | ● | ● | Formula(5b) | Formula(6a) | Formula(7e) |
| 3 | ● | ○ | ● | ● | Formula(5a) | Formula(6b) | Formula(7f) |
| 4 | ● | ● | ○ | ● | Formula(5c) | Formula(6a) | Formula(7g) |
| 5 | ● | ● | ● | ○ | Formula(5a) | Formula(6c) | Formula(7h) |
| 6 | ○ | ○ | ● | ● | Formula(5b) | Formula(6b) | Formula(7b) |
| 7 | ○ | ● | ○ | ● | Formula(5d) | Formula(6a) | Formula(7i) |
| 8 | ○ | ● | ● | ○ | Formula(5b) | Formula(6c) | Formula(7j) |
| 9 | ● | ○ | ○ | ● | Formula(5c) | Formula(6b) | Formula(7k) |
| 10 | ● | ○ | ● | ○ | Formula(5a) | Formula(6d) | Formula(7l) |
| 11 | ● | ● | ○ | ○ | Formula(5c) | Formula(6c) | Formula(7c) |
| 12 | ○ | ○ | ○ | ● | Formula(5d) | Formula(6b) | Formula(7m) |
| 13 | ○ | ○ | ● | ○ | Formula(5b) | Formula(6d) | Formula(7n) |
| 14 | ○ | ● | ○ | ○ | Formula(5d) | Formula(6c) | Formula(7o) |
| 15 | ● | ○ | ○ | ○ | Formula(5c) | Formula(6d) | Formula(7p) |
| 16 | ○ | ○ | ○ | ○ | Formula(5d) | Formula(6d) | Formula(7d) |

●: estimation,
○: measurement

The following four cases will be described below.

(Case 1) $\mu_{WM}$, $\mu_{WB}$, $\phi_{WM}$, and $\phi_{WB}$ are all acquired through estimation (Case 6) $\mu_{WM}$ and $\mu_{WB}$ are acquired through measurement, and $\phi_{WM}$ and $\phi_{WB}$ are acquired through estimation (Case 11) $\mu_{WM}$ and $\mu_{WB}$ are acquired through estimation, and $\phi_{WM}$ and $\phi_{WB}$ are acquired through measurement (Case 16) $\mu_{WM}$, $\mu_{WB}$, $\phi_{WM}$, and $\phi_{WB}$ are all acquired through measurement After these four cases have been described, the other cases will be described.

[2-1. Case Where $\mu_{WM}$, $\mu_{WB}$, $\phi_{WM}$, and $\phi_{WB}$ are All Acquired Through Estimation (Case 1)]

First, a method for calculating the rolling load difference attributable to the thrust forces in a case where $\mu_{WM}$, $\mu_{WB}$, $\phi_{WM}$, and $\phi_{WB}$ are all acquired through estimation (Case 1) will be described. In FIG. 2, equilibrium of forces in the roll-axis direction acting on the lower work roll 2, equilibrium of forces in the roll-axis direction acting on the lower backup roll 4, and equilibrium of moments in the lower roll assembly are expressed by the following Formulas (1) to (3).

[Expression 1]

$$T_{WB}^{B} = T_{W}^{B} + T_{WM}^{B} \tag{1}$$

$$T_{R}^{B} = T_{WR}^{B} \tag{2}$$

$$\frac{a}{2} \times P_{df}^{T\,B} = \left(\frac{D_B}{2} + h_B^{B}\right) \times T_B^{B} + \frac{D_W}{2} \times T_W^{B} + D_W \times T_{WM}^{B} \tag{3}$$

Symbols represent the following components.

$T_{WB}^{B}$: Thrust force that acts between the lower work roll 2 and the lower backup roll 4 (inter-roll thrust force)

$T_{WM}^{B}$: Thrust force that acts between the lower work roll 2 and the workpiece S (material-roll thrust force)

$T_{W}^{B}$: Thrust counterforce that acts on the lower work roll chocks 6*a* and 6*b*

$T_{B}^{B}$: Thrust counterforce that acts on the lower backup roll chocks 8*a* and 8*b*

$P^{T}_{df}{}^{B}$: Load difference attributable to the thrust forces a: span between rolling supports $h_B{}^B$: Working point position of a thrust counterforce that acts on the lower backup roll chocks 8*a* and 8*b*

$D_B$: Diameter of the lower backup roll 4

$D_W$: Diameter of the lower work roll 2

By removing $T_B{}^B$ from the above Formulas (1) to (3), $P^{T}_{df}{}^{B}$ can be expressed by any one of the following Formulas (4-1) to (4-3).

[Expression 2]

$$P^{T}_{df}{}^{B} = \alpha T_{WM}{}^{B} + \beta T_{WB}{}^{B} \tag{4-1}$$

$$P^{T}_{df}{}^{B} = (\alpha + \beta) T_{WM}{}^{B} - \beta T_{WB}{}^{B} \tag{4-2}$$

$$P^{T}_{df}{}^{B} = (\alpha + \beta) T_{WM}{}^{B} + \beta T_{WB}{}^{B} \tag{4-3}$$

Here, $$\alpha = \frac{D_W}{a}, \beta = \frac{D_B + D_W + 2h_B{}^B}{a}$$

This shows that, as described above, at least any one of the material-roll thrust force $T_{WM}{}^B$ and the inter-roll thrust force $T_{WB}{}^B$ needs to be estimated to determine the rolling load difference $P^{T}_{df}{}^{B}$ attributable to the thrust forces.

Here, the material-roll thrust force $T_{WM}{}^B$ and the inter-roll thrust force $T_{WB}{}^B$ are expressed by, for example, the following Formulas (5a) and (6a) according to Non Patent Document 1.

[Expression 3]

$$T_{WM}{}^{B} = 2\mu_{WM}\phi_{WM}\gamma \ln\left(\frac{0.5 + \sqrt{(\phi_{WM}\gamma)^2 + 0.25}}{|\phi_{WM}\gamma|}\right)P = T_{WM}{}^{B}(\mu_{WM}, \phi_{WM}, P, r) \tag{5a}$$

$$T_{WM}{}^{B} = \mu_{WB}\left\{1 - \left[\frac{\tan\phi_{WB}}{\left(\frac{1}{G_W} + \frac{1}{G_B}\right)\mu_{WB}p_0}\right]^2\right\}P = T_{WB}{}^{B}(\mu_{WB}, \phi_{WB}, P) \tag{6a}$$

Symbols represent the following components.

$\mu_{WM}$: Friction coefficient between the lower work roll 2 and the workpiece S $\mu_{WB}$: Friction coefficient between the lower work roll 2 and the lower backup roll 4

$\phi_{WM}$: Cross angle between the lower work roll 2 and the workpiece S $\phi_{WB}$: Inter-roll cross angle between the lower work roll 2 and the lower backup roll 4

$\gamma=(1-r)/r$ (r: rolling reduction rate)

$G_W$: Modulus of rigidity of a work roll $G_B$: Modulus of rigidity of a backup roll $p_0$: Maximum contact pressure between rolls P: Rolling load That is, it is understood that calculation of the material-roll thrust force $T_{WM}{}^B$ requires the friction coefficient $\mu_{WM}$ between the lower work roll 2 and the workpiece S, the cross angle $\phi_{WM}$ between the lower work roll 2 and the workpiece S, the rolling load P, and the rolling reduction rate r. It is also understood that calculation of the inter-roll thrust force $T_{WB}{}^B$ requires the friction coefficient $\mu_{WB}$ between the lower work roll 2 and the lower backup roll 4, the inter-roll cross angle $\phi_{WB}$ between the lower work roll 2 and the lower backup roll 4, and the rolling load P.

Therefore, with Formula (1), the thrust counterforce $T_W{}^B$ acting on the lower work roll chocks 6*a* and 6*b* can be expressed by the following Formula (7a).

[Expression 4]

$$T_W{}^B = T_{WB}{}^B - T_{WM}{}^B = f'(\mu_{WM}, \mu_{WB}, \phi_{WM}, \phi_{WB}, P, r) \tag{7a}$$

In Formula (7a), the rolling load P and the rolling reduction rate r can be acquired in a form of their actual values or their setting values. In contrast, the friction coefficient $\mu_{WM}$ between the lower work roll 2 and the workpiece S, the friction coefficient $\mu_{WB}$ between the lower work roll 2 and the lower backup roll 4, the cross angle $\phi_{WM}$ between the lower work roll 2 and the workpiece S, and the inter-roll cross angle $\phi_{WB}$ between the lower work roll 2 and the lower backup roll 4 are unknowns. In order to determine the four unknowns, the thrust counterforce $T_W{}^B$ acting on the lower work roll chocks 6*a* and 6*b* is to be measured for combinations of the rolling load P and the rolling reduction rate r at four levels or more. At fifth and subsequent levels, the material-roll thrust force $T_{WM}{}^B$ and the inter-roll thrust force $T_{WB}{}^B$ can be acquired from the above Formulas (5a) and (6a) with values of the unknowns determined at the four levels and the rolling load P and the rolling reduction rate r at the fifth and subsequent levels.

By using the material-roll thrust force $T_{WM}{}^B$ and the inter-roll thrust force $T_{WB}{}^B$ acquired in this manner, and the measured roll-axis-direction thrust counterforce, the load difference $P^{T}_{df}{}^{B}$ attributable to the thrust forces can be calculated from any one of the above Formulas (4-1) to (4-3).

[2-2. Case Where $\mu_{WM}$ and $\mu_{WB}$ are Acquired Through Measurement, and $\phi_{WM}$ and $\phi_{WB}$ are Acquired Through Estimation (Case 6)]

Next, a method for calculating the rolling load difference attributable to the thrust forces in a case where $\mu_{WM}$ and $\mu_{WB}$ are acquired through measurement, and $\phi_{WM}$ and $\phi_{WB}$ are acquired through estimation (Case 6) will be described. In this case, the material-roll thrust force $T_{WM}{}^B$ and the inter-roll thrust force $T_{WB}{}^B$ that are expressed by Formulas (5a) and (6a) in Case 1 are expressed by the following Formulas (5b) and (6b).

[Expression 5]

$$T_{WM}{}^{B} = 2\mu_{WM}\phi_{WM}\gamma \ln\left(\frac{0.5 + \sqrt{(\phi_{WM}\gamma)^2 + 0.25}}{|\phi_{WM}\gamma|}\right)P = T_{WM}{}^{B}(\phi_{WM}, P, r) \tag{5b}$$

$$T_{WB}{}^{B} = \mu_{WB}\left\{1 - \left[1 - \frac{\tan\phi_{WB}}{\left(\frac{1}{G_W} + \frac{1}{G_B}\right)\mu_{WB}p_0}\right]^2\right\}P = T_{WB}{}^{B}(\phi_{WB}, P) \tag{6b}$$

That is, it is understood that calculation of the material-roll thrust force $T_{WM}{}^B$ requires the cross angle $\phi_{WM}$ between the lower work roll 2 and the workpiece S, the rolling load P, and the rolling reduction rate r. It is also understood that calculation of the inter-roll thrust force $T_{WB}{}^B$ requires the inter-roll cross angle $\phi_{WB}$ between the lower work roll 2 and the lower backup roll 4, and the rolling load P.

Therefore, with Formula (1), the thrust counterforce $T_W{}^B$ acting on the lower work roll chocks 6*a* and 6*b* can be expressed by the following Formula (7b).

[Expression 6]

$$T_W{}^B = T_{WB}{}^B - T_{WM}{}^B = f'(\phi_{WM}, \phi_{WB}, P, r) \tag{7b}$$

In Formula (7b), the rolling load P and the rolling reduction rate r can be acquired in a form of their actual values or their setting values. In contrast, the cross angle $\phi_{WM}$ between the lower work roll 2 and the workpiece S, and the inter-roll cross angle $\phi_{WB}$ between the lower work roll 2 and the lower backup roll 4 are unknowns. In order to determine the two unknowns, the thrust counterforce $T_W^B$ acting on the lower work roll chocks 6*a* and 6*b* is to be measured for combinations of the rolling load P and the rolling reduction rate r at two levels or more. At third and subsequent levels, the material-roll thrust force $T_{WM}^B$ and the inter-roll thrust force $T_{WB}^B$ can be acquired from the above Formulas (5b) and (6b) with values of the unknowns determined at the two levels and the rolling load P and the rolling reduction rate r at the third and subsequent levels.

By using the material-roll thrust force $T_{WM}^B$ and the inter-roll thrust force $T_{WB}^B$ acquired in this manner, and the measured roll-axis-direction thrust counterforce, the load difference $P^{T}_{df}{}^{B}$ attributable to the thrust forces can be calculated from any one of the above Formulas (4-1) to (4-3).

[2-3. Case Where $\mu_{WM}$ and $\mu_{WB}$ are Acquired Through Estimation, and $\phi_{WM}$ and $\phi_{WB}$ are Acquired Through Measurement (Case 11)]

Next, a method for calculating the rolling load difference attributable to the thrust forces in a case where $\mu_{WM}$ and $\mu_{WB}$ are acquired through estimation, and $\phi_{WM}$ and $\phi_{WB}$ are acquired through measurement (Case 11) will be described. In this case, the material-roll thrust force $T_{WM}^B$ and the inter-roll thrust force $T_{WB}^B$ that are expressed by Formulas (5a) and (6a) in Case 1 are expressed by the following Formulas (5c) and (6c).

[Expression 7]

$$T_{WM}^B = 2\mu_{WM}\phi_{WM}\gamma \ln\left(\frac{0.5+\sqrt{(\phi_{WM}\gamma)^2+0.25}}{|\phi_{WM}\gamma|}\right)P = T_{WM}^B(\mu_{WM}, P, r) \tag{5c}$$

$$T_{WB}^B = \mu_{WB}\left\{1-\left[1-\frac{\tan\phi_{WB}}{\left(\frac{1}{G_W}+\frac{1}{G_B}\right)\mu_{WB}p_0}\right]^2\right\}P = T_{WB}^B(\mu_{WB}, P) \tag{6c}$$

That is, it is understood that calculation of the material-roll thrust force $T_{WM}^B$ requires the friction coefficient $\mu_{WM}$ between the lower work roll 2 and the workpiece S, the rolling load P, and the rolling reduction rate r. It is also understood that calculation of the inter-roll thrust force $T_{WB}^B$ requires the friction coefficient $\mu_{WB}$ between the lower work roll 2 and the lower backup roll 4, and the rolling load P.

Therefore, with Formula (1), the thrust counterforce $T_W^B$ acting on the lower work roll chocks 6*a* and 6*b* can be expressed by the following Formula (7c).

[Expression 8]

$$T_W^B = T_{WB}^B - T_{WM}^B = f'(\mu_{WM}, \mu_{WB}, P, r) \tag{7c}$$

In Formula (7c), the rolling load P and the rolling reduction rate r can be acquired in a form of their actual values or their setting values. In contrast, the friction coefficient $\mu_{WM}$ between the lower work roll 2 and the workpiece S, and the friction coefficient $\mu_{WB}$ between the lower work roll 2 and the lower backup roll 4 are unknowns. In order to determine the two unknowns, the thrust counterforce $T_W^B$ acting on the lower work roll chocks 6*a* and 6*b* is to be measured for combinations of the rolling load P and the rolling reduction rate r at two levels or more. At third and subsequent levels, the material-roll thrust force $T_{WM}^B$ and the inter-roll thrust force $T_{WB}^B$ can be acquired from the above Formulas (5c) and (6c) with values of the unknowns determined at the two levels and the rolling load P and the rolling reduction rate r at the third and subsequent levels.

By using the material-roll thrust force $T_{WM}^B$ and the inter-roll thrust force $T_{WB}^B$ acquired in this manner, and the measured roll-axis-direction thrust counterforce, the load difference $P^{T}_{df}{}^{B}$ attributable to the thrust forces can be calculated from any one of the above Formulas (4-1) to (4-3).

[2-4. Case Where $\mu_{WM}$, $\mu_{WB}$, $\phi_{WM}$, and $\phi_{WB}$ are All Acquired Through Measurement (Case 16)]

Next, a method for calculating the rolling load difference attributable to the thrust forces in a case where $\mu_{WM}$, $\mu_{WB}$, $\phi_{WM}$, and $\phi_{WB}$ are all acquired through measurement (Case 16) will be described. In this case, the material-roll thrust force $T_{WM}^B$ and the inter-roll thrust force $T_{WB}^B$ that are expressed by Formulas (5a) and (6a) in Case 1 are expressed by the following Formulas (5d) and (6d).

[Expression 9]

$$T_{WM}^B = 2\mu_{WM}\phi_{WM}\gamma \ln\left(\frac{0.5+\sqrt{(\phi_{WM}\gamma)^2+0.25}}{|\phi_{WM}\gamma|}\right)P = T_{WM}^B(P, r) \tag{5d}$$

$$T_{WB}^B = \mu_{WB}\left\{1-\left[1-\frac{\tan\phi_{WB}}{\left(\frac{1}{G_W}+\frac{1}{G_B}\right)\mu_{WB}p_0}\right]^2\right\}P = T_{WB}^B(P) \tag{6d}$$

That is, it is understood that calculation of the material-roll thrust force $T_{WM}^B$ requires the rolling load P and the rolling reduction rate r. It is also understood that calculation of the inter-roll thrust force $T_{WB}^B$ requires the rolling load P.

Therefore, with Formula (1), the thrust counterforce $T_W^B$ acting on the lower work roll chocks 6*a* and 6*b* can be expressed by the following Formula (7d).

[Expression 10]

$$T_W^B = T_{WB}^B - T_{WM}^B = f'(P, r) \tag{7d}$$

In Formula (7d), the rolling load P and the rolling reduction rate r can be acquired in a form of their actual values or their setting values. Since there are no unknowns, the material-roll thrust force $T_{WM}^B$ and the inter-roll thrust force $T_{WB}^B$ can be acquired from Formulas (5d) and (6d) with the rolling load P and the rolling reduction rate r at a first and subsequent levels.

By using the material-roll thrust force $T_{WM}^B$ and the inter-roll thrust force $T_{WB}^B$ acquired in this manner, and the measured roll-axis-direction thrust counterforce, the load difference $P^{T}_{df}{}^{B}$ attributable to the thrust forces can be calculated from any one of the above Formulas (4-1) to (4-3).

As above, the method for calculating the rolling load difference attributable to the thrust forces in accordance with the four patterns of acquiring the material-roll cross angle, the inter-roll cross angle, the material-roll friction coefficient, and the inter-roll friction coefficient is described. For the cases other than the above cases, as shown in the above Table 1, the material-roll thrust force $T_{WM}^{B}$ can be determined by any one of the above Formulas (5a) to (5d), and the inter-roll thrust force $T_{WB}^{B}$ can be determined by any one of the Formulas (6a) to (6d). Note that the formula that expresses the thrust counterforce $T_{W}^{B}$ acting on the work roll chocks 6*a* and 6*b* differs in each case. Specific formulas are as follows.

[Expression 11]

$$\text{(Case 2): } T_W^B = T_{WB}^B - T_{WM}^B = f'(\mu_{WB}, \Phi_{WM}, \Phi_{WB}, P, r) \quad (7e)$$

$$\text{(Case 3): } T_W^B = T_{WB}^B - T_{WM}^B = f'(\mu_{WM}, \Phi_{WM}, \Phi_{WB}, P, r) \quad (7f)$$

$$\text{(Case 4): } T_W^B = T_{WB}^B - T_{WM}^B = f'(\mu_{WM}, \mu_{WB}, \Phi_{WB}, P, r) \quad (7g)$$

$$\text{(Case 5): } T_W^B = T_{WB}^B - T_{WM}^B = f'(\mu_{WM}, \mu_{WB}, \Phi_{WM}, P, r) \quad (7h)$$

$$\text{(Case 7): } T_W^B = T_{WB}^B - T_{WM}^B = f'(\mu_{WB}, \Phi_{WB}, P, r) \quad (7i)$$

$$\text{(Case 8): } T_W^B = T_{WB}^B - T_{WM}^B = f'(\mu_{WB}, \Phi_{WM}, P, r) \quad (7j)$$

$$\text{(Case 9): } T_W^B = T_{WB}^B - T_{WM}^B = f'(\mu_{WM}, \Phi_{WB}, P, r) \quad (7k)$$

$$\text{(Case 10): } T_W^B = T_{WB}^B - T_{WM}^B = f'(\mu_{WM}, \Phi_{WM}, P, r) \quad (7l)$$

$$\text{(Case 12): } T_W^B = T_{WB}^B - T_{WM}^B = f'(\Phi_{WB}, P, r) \quad (7m)$$

$$\text{(Case 13): } T_W^B = T_{WB}^B - T_{WM}^B = f'(\Phi_{WM}, P, r) \quad (7n)$$

$$\text{(Case 14): } T_W^B = T_{WB}^B - T_{WM}^B = f'(\mu_{WB}, P, r) \quad (7o)$$

$$\text{(Case 15): } T_W^B = T_{WB}^B - T_{WM}^B = f'(\mu_{WM}, P, r) \quad (7p)$$

[3. Zigzagging Control Method]

[3-1. Outline]

Figure 3:
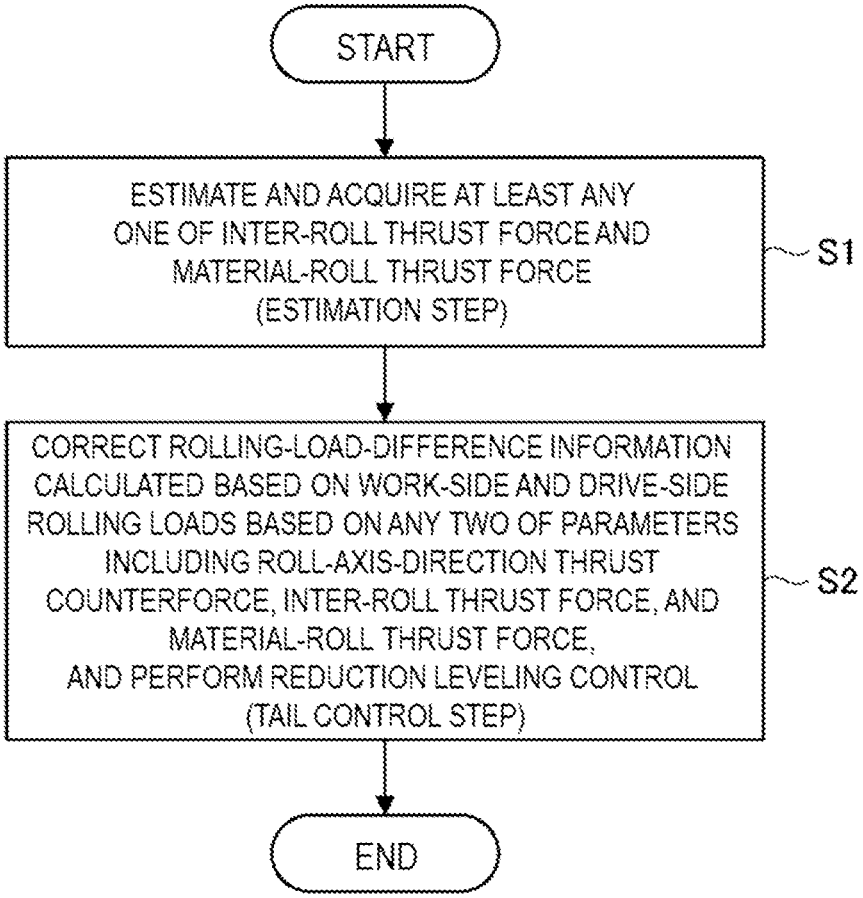
FIG. 3 is a flowchart illustrating an outline of a zigzagging control method for a workpiece according to an embodiment of the present invention.
Figure 4:
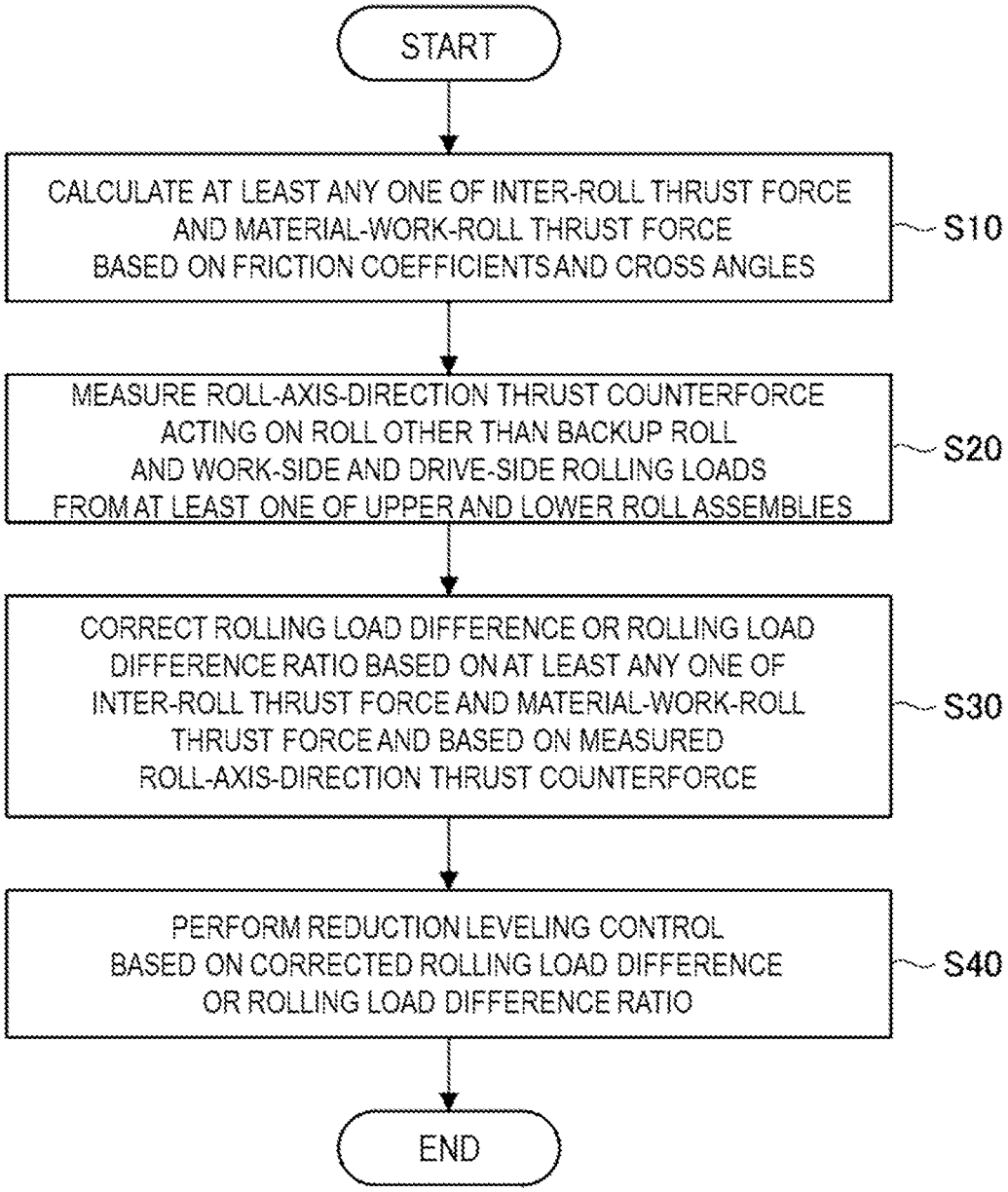
FIG. 4 is a flowchart illustrating an example of the zigzagging control method for a workpiece according to the embodiment.

A zigzagging control method for a workpiece according to the present embodiment will be described below with reference to FIG. 3 and FIG. 4. FIG. 3 is a flowchart illustrating an outline of the zigzagging control method for a workpiece according to the present embodiment. FIG. 4 is a flowchart illustrating an example of the zigzagging control method for a workpiece according to the present embodiment. The zigzagging control method for a workpiece according to the present embodiment includes an estimation step (S1 of FIG. 3, S10 of FIG. 4) that is performed before rolling of a tail portion of the workpiece, and a tail control step (S2 of FIG. 3, S20 to S40 of FIG. 4) that is performed during the rolling of the tail portion of the workpiece.

As illustrated in FIG. 3, in the estimation step, at least any one of the inter-roll thrust force and the material-roll thrust force is acquired through estimation (S1 of FIG. 3). The inter-roll thrust force can be estimated based on the inter-roll cross angle and the inter-roll friction coefficient. The material-roll thrust force can be estimated based on the material-roll cross angle and the material-roll friction coefficient. As shown in the above Table 1, the inter-roll cross angle, the material-roll cross angle, the inter-roll friction coefficient, and the material-roll friction coefficient are each acquired through measurement or estimation.

In the tail control step, rolling-load-difference information calculated based on work-side and drive-side rolling loads is corrected based on any two of parameters including the roll-axis-direction thrust counterforce, the inter-roll thrust force, and the material-roll thrust force, and perform reduction leveling control (S2 of FIG. 3).

First, the work-side and drive-side rolling loads are measured from at least any one of the upper and lower roll assemblies. Next, the rolling-load-difference information is corrected based on any two of the parameters including the roll-axis-direction thrust counterforce, the inter-roll thrust force, and the material-roll thrust force. The roll-axis-direction thrust counterforce is a thrust counterforce acting on roll other than the backup roll and is measured from at least any one of the upper and lower roll assemblies from which the work-side and drive-side rolling loads are measured. The roll-axis-direction thrust counterforce can be measured concurrently with the measurement of the rolling loads. The inter-roll thrust force and the material-roll thrust force can be acquired in step S1. Then, based on any two of the acquired parameters, the rolling-load-difference information is corrected, and based on the corrected rolling-load-difference information, the reduction leveling control is performed on the rolling mill.

As long as the any two of the parameters including the roll-axis-direction thrust counterforce, the inter-roll thrust force, and the material-roll thrust force are acquired, the differential load attributable to the inter-roll thrust force can be determined accurately. The two parameters can be selected freely. For example, parameters that can be acquired more accurately may be selected to determine the differential load attributable to the inter-roll thrust force.

FIG. 4 illustrates processing in a case where the roll-axis-direction thrust counterforce, and either the inter-roll thrust force or the material-roll thrust force are selected as the two parameters.

In the processing illustrated in FIG. 4, first, the roll-axis-direction thrust counterforce acting on a roll other than a backup roll and the work-side and drive-side rolling loads are measured at the same time from the at least any one of the upper and lower roll assemblies (S20). The roll-axis-direction thrust counterforce is measured at the measurement of the work-side and drive-side rolling loads. Here, it will suffice to acquire the roll-axis-direction thrust counterforce and the work-side and drive-side rolling loads within a period in which tail control works effectively; they are not necessarily measured strictly at the same time. Next, based on the measured roll-axis-direction thrust counterforce, and the inter-roll thrust force or the material-roll thrust force acquired in step S10, rolling-load-difference information calculated based on the measured work-side and drive-side rolling loads is corrected (S30). Examples of the rolling-load-difference information include a rolling load difference that is a difference between the work-side and drive-side rolling loads, a rolling load difference ratio, and the like. Then, based on the corrected rolling-load-difference information, reduction leveling control is performed on the rolling mill (S40).

In the zigzagging control method for a workpiece according to the present embodiment, zigzagging control is performed on a workpiece with the material-roll thrust force or the inter-roll thrust force taken into consideration and with influence of a cross angle (e.g., change over time due to wearing away of a liner) and influence of a friction coefficient (e.g., change over time due to wearing away or surface deterioration of a roll) taken into consideration. This enables leveling correction to be performed with influence of the thrust forces taken into consideration more accurately, and thus the centerline deviation can be reduced. In addition, the zigzagging control method for a workpiece according to the present embodiment can be implemented simply because there is no need to install measurement equipment on a line.

The zigzagging control method for a workpiece will be specifically described below for the following four cases.

(Case 1) $\mu_{WM}$, $\mu_{WB}$, $\phi_{WM}$, and $\phi_{WB}$ are all acquired through estimation (Case 6) $\mu_{WM}$ and $\mu_{WB}$ are acquired through measurement, and $\phi_{WM}$ and $\phi_{WB}$ are acquired through estimation (Case 11) $\mu_{WM}$ and $\mu_{WB}$ are acquired through estimation, and $\phi_{WM}$ and $\phi_{WB}$ are acquired through measurement (Case 16) $\mu_{WM}$, $\mu_{WB}$, $\phi_{WM}$, and $\phi_{WB}$ are all acquired through measurement

[3-2. Case where $\mu_{WM}$, $\mu_{WB}$, $\phi_{WM}$, and $\phi_{WB}$ are All Acquired Through Estimation (Case 1)]

Figure 5:
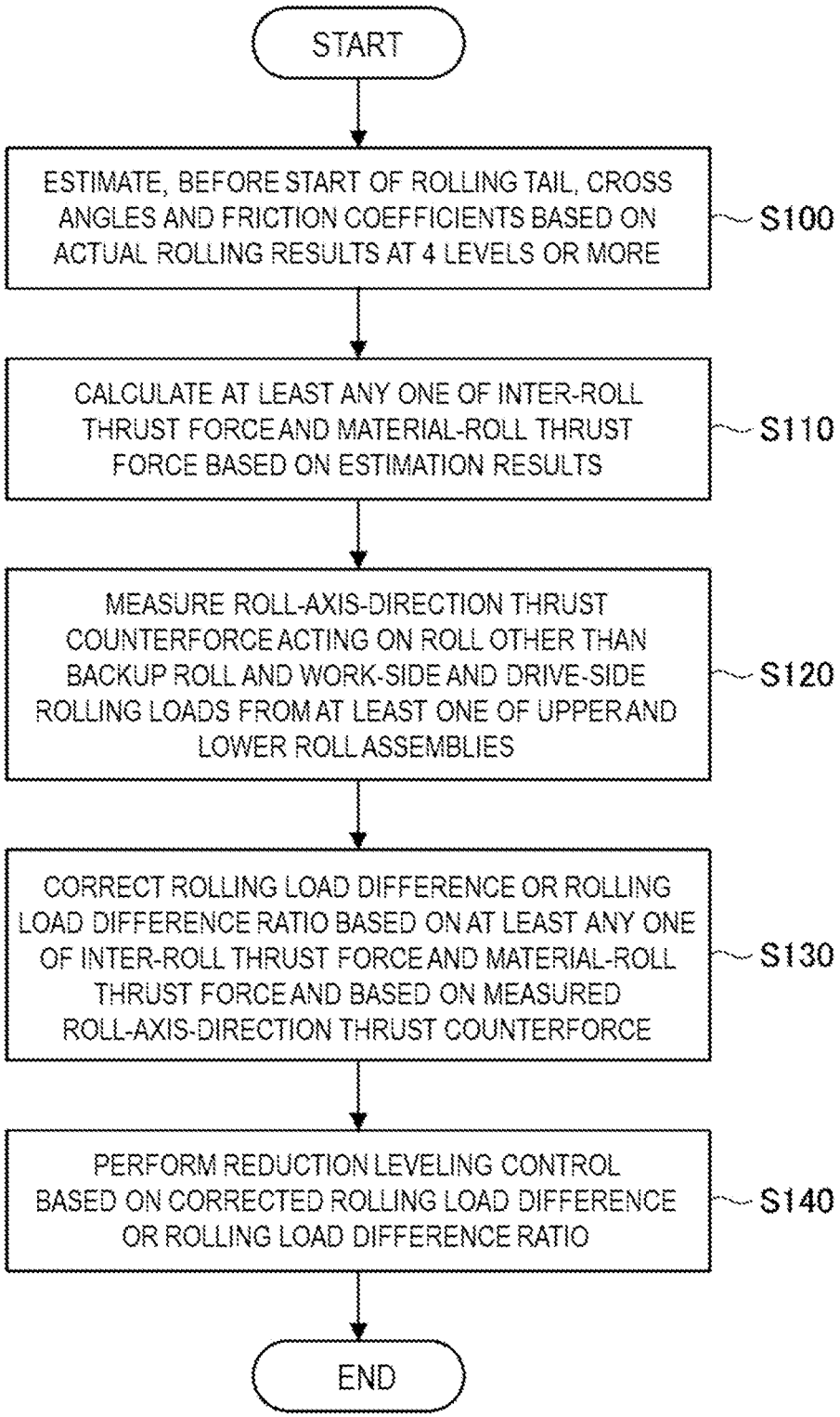
FIG. 5 is a flowchart illustrating a zigzagging control method for a workpiece in a case where $\mu_{WM}$, $\mu_{WB}$, $\phi_{WM}$, and $\phi_{WB}$ are all acquired through estimation (Case 1).

First, with reference to FIG. 5, a zigzagging control method for a workpiece in a case where $\mu_{WM}$, $\mu_{WB}$, $\phi_{WM}$, and $\phi_{WB}$ are all acquired through estimation (Case 1) will be described. FIG. 5 is a flowchart illustrating the zigzagging control method for a workpiece in the case where $\mu_{WM}$, $\mu_{WB}$, $\phi_{WM}$, and $\phi_{MB}$ are all acquired through estimation (Case 1).

As illustrated in FIG. 5, first, before rolling of a tail portion of the workpiece is started, the estimation unit 110 performs estimation processing for acquiring the inter-roll cross angle, the material-roll cross angle, the inter-roll friction coefficient, and the material-roll friction coefficient based on actual rolling results that include rolling loads, rolling reduction rates, and thrust counterforces acting on a roll other than the backup roll at four levels or more (S100). The rolling loads and the rolling reduction rates used in step S100 may be either their actual values or their setting values. The thrust counterforces are measured values obtained by measurement at each level. The actual rolling results at four levels or more used in step S100 are stored in the actual rolling result database 200. From the actual rolling result database 200, the estimation unit 110 acquires four or more actual rolling results that have been acquired from at least any one of the upper and lower roll assemblies.

Here, the actual rolling results at four levels or more used for the estimation do not have to be data that has been acquired continuously on a time-series basis; it will suffice that the actual rolling results are those of any workpieces that have been rolled before a workpiece of which a tail portion is to pass later. On the assumption that, while a workpiece that is continuous on a time-series basis passes, the friction coefficients and the cross angles in a stationary rolling state hardly change, the friction coefficients and the cross angles can be acquired with change over time taken into consideration by using actual rolling results acquired for four workpieces rolled recently in the estimation. Note that the workpieces rolled recently refer to workpieces that are rolled within a period prior to rolling of the workpiece in question in which the friction coefficient or the cross angle can be assumed not to be changed by a replacement of a roll, wearing away of a roll, or the like. In addition, the actual rolling results at four levels or more may be values that are acquired from different workpieces or may be actual rolling results at a plurality of levels acquired from the same workpieces. An accuracy of the acquired friction coefficient and cross angle increases with an increase in the number of the levels.

The estimation unit 110 calculates at least any one of the material-roll thrust force $T_{WM}^{B}$ and the inter-roll thrust force $T_{WB}^{B}$ based on the inter-roll cross angle, the material-roll cross angle, the inter-roll friction coefficient, and the material-roll friction coefficient that are acquired as a result of the estimation in step S100 (S110). The material-roll thrust force $T_{WM}^{B}$ can be determined by, for example, the above Formula (5a), and the inter-roll thrust force $T_{WB}^{B}$ can be determined by, for example, the above Formula (6a). The processes up to step S110 are performed before the rolling of the tail portion of the workpiece is started. Steps S100 and S110 correspond to step S1 of the processing illustrated in FIG. 3.

Next, during the rolling of the tail portion of the workpiece, the tail control illustrated as the following steps S120 to S140 is performed. Steps S120 to S140 correspond to step S2 of the processing illustrated in FIG. 3.

First, the roll-axis-direction thrust counterforce acting on a roll other than a backup roll and the work-side and drive-side rolling loads are measured at the same time from the at least any one of the upper and lower roll assemblies (S120). Note that it will suffice to acquire the roll-axis-direction thrust counterforce and the work-side and drive-side rolling loads within a period in which tail control works effectively; they are not necessarily measured strictly at the same time. The roll-axis-direction thrust counterforces are measured by the thrust counterforce measurement apparatuses 12*a* and 12*b*. The drive-side rolling load is measured by the lower load sensor 11*a*, and the work-side rolling load is measured by the lower load sensor 11*b*. The acquired roll-axis-direction thrust counterforces and work-side and drive-side rolling loads are output to the differential-load thrust-counterforce acquisition unit 120. From the work-side and drive-side rolling loads, the differential-load thrust-counterforce acquisition unit 120 calculates a load difference or a load difference ratio.

Next, based on the measured roll-axis-direction thrust counterforce, and the inter-roll thrust force or the material-roll thrust force calculated by the estimation unit 110, the correction unit 130 corrects the rolling load difference or the rolling load difference ratio calculated based on the measured work-side and drive-side rolling loads (S130). The correction unit 130 calculates the rolling load difference attributable to the thrust forces based on any one of the above Formulas (4-1) to (4-3). Then, the rolling load difference is corrected by removing the calculated rolling load difference attributable to the thrust forces from the rolling load difference calculated based on the work-side and drive-side rolling loads measured in step S120. The correction applies similarly to a case of the rolling load difference ratio.

The leveling control unit 140 thereafter performs the reduction leveling control based on the rolling load difference or the rolling load difference ratio corrected by the correction unit 130 (S140). The leveling control unit 140 calculates controlled variables of the leveling devices 13*a* and 13*b* and drives leveling devices 13*a* and 13*b* based on the controlled variables.

As above, the zigzagging control method for a workpiece in the case where $\mu_{WM}$, $\mu_{WB}$, $\phi_{WM}$, and $\phi_{WB}$ are all acquired through estimation (Case 1) is described.

[3-3. Case Where $\mu_{WM}$ and $\mu_{WB}$ are Acquired Through Measurement, and $\phi_{WM}$ and $\phi_{WB}$ are Acquired Through Estimation (Case 6)]

Figure 6:
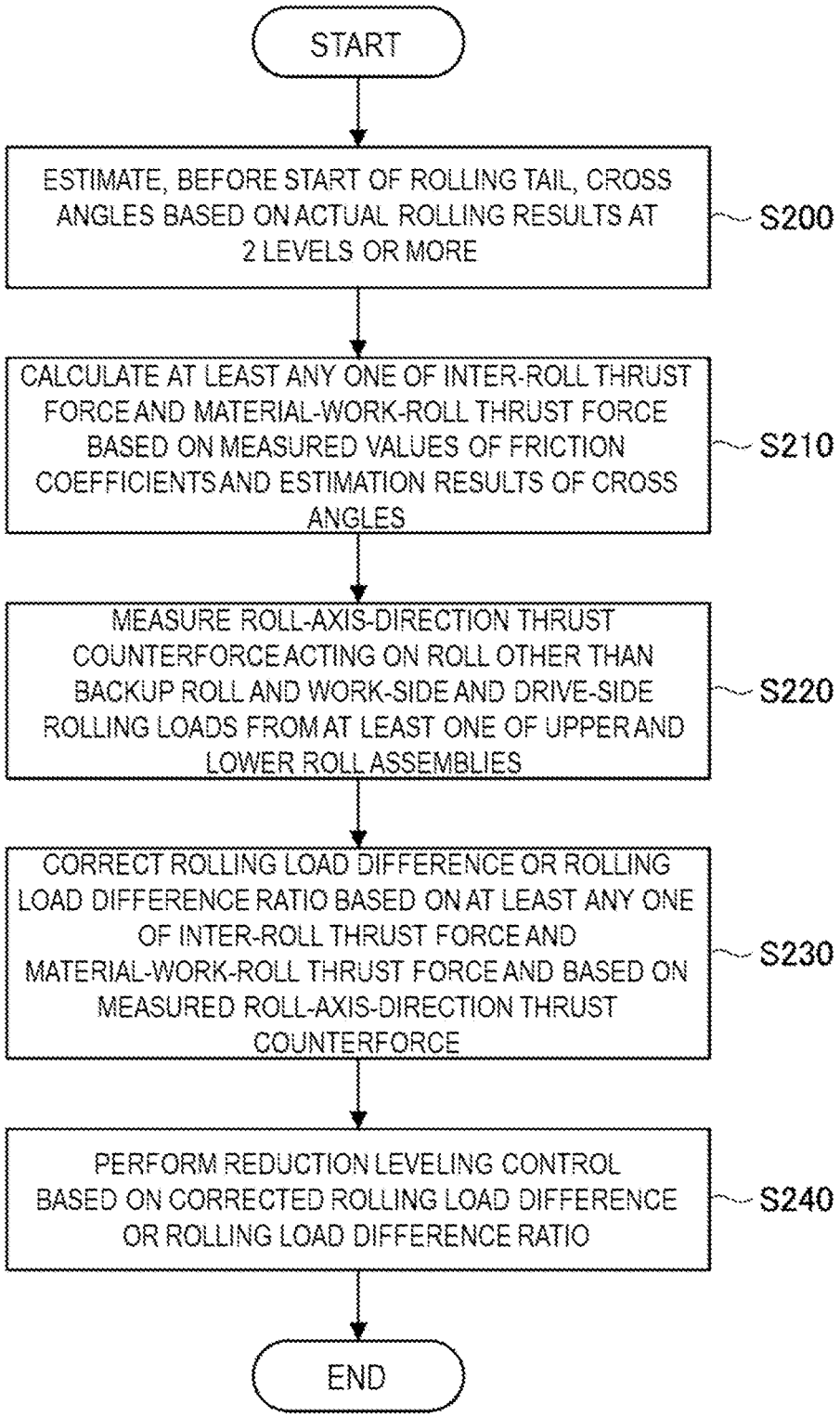
FIG. 6 is a flowchart illustrating a zigzagging control method for a workpiece in a case where $\mu_{WM}$ and $\mu_{WB}$ and $\mu_{WB}$ are acquired through measurement, and $\phi_{WM}$ and $\phi_{WB}$ are acquired through estimation (Case 6).
Figure 7:
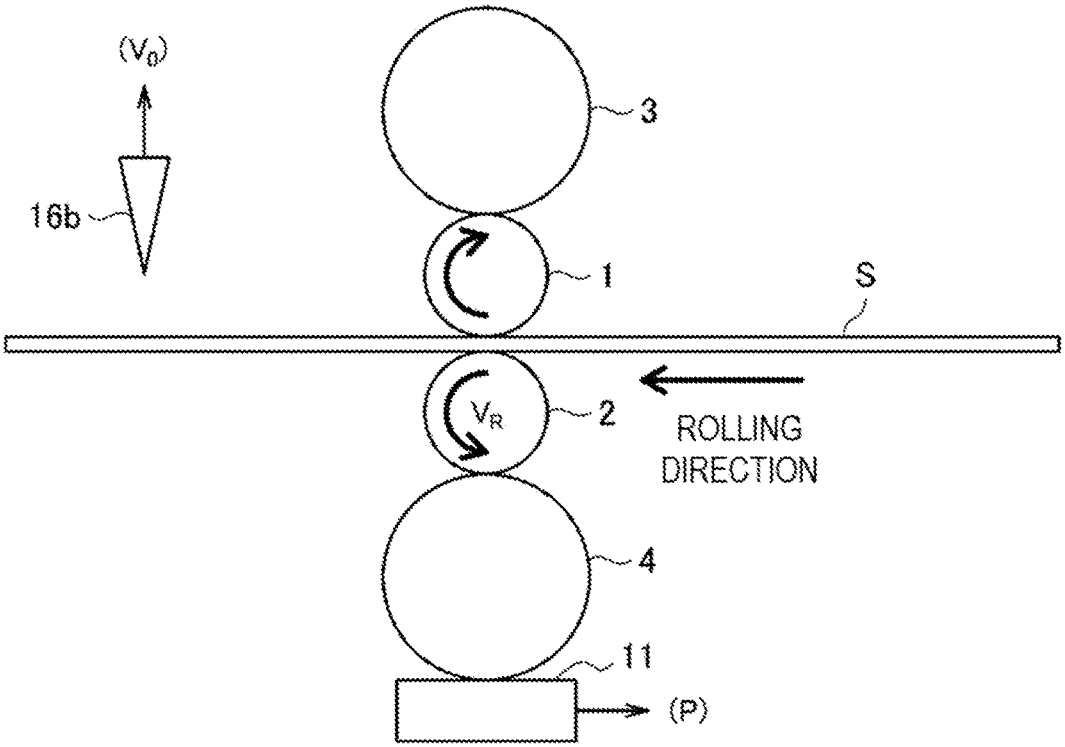
FIG. 7 is an explanatory diagram illustrating an example of a method for measuring a friction coefficient.
Figure 8:
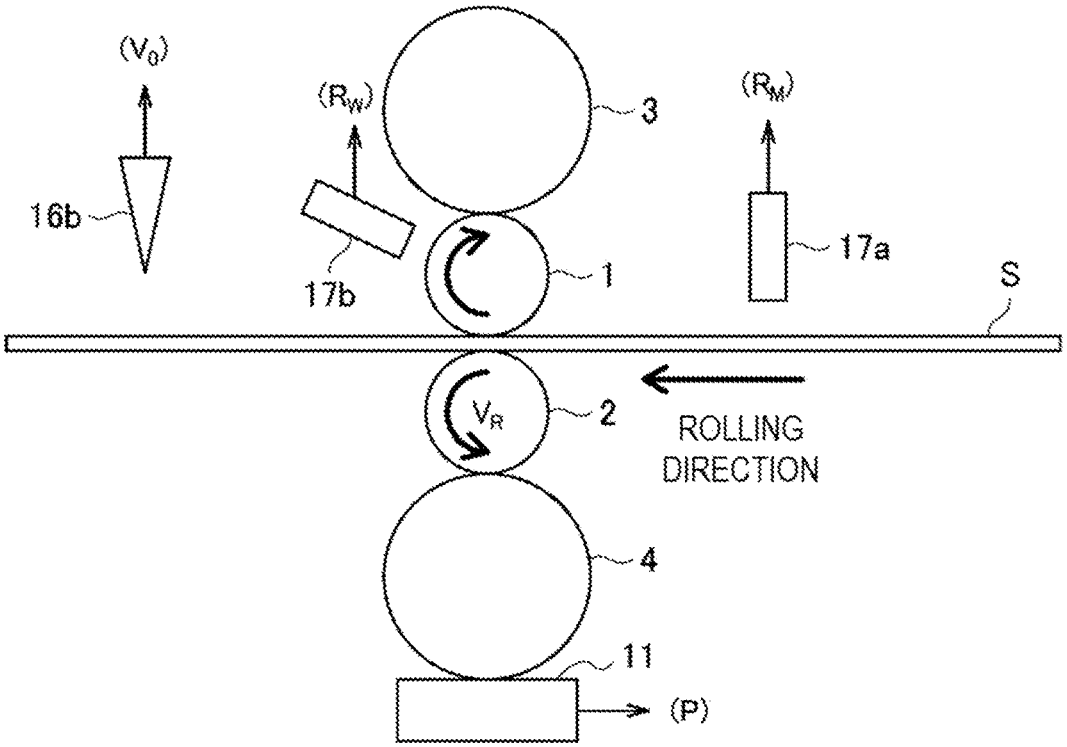
FIG. 8 is an explanatory diagram illustrating another example of the method for measuring a friction coefficient.

Next, with reference to FIG. 6 to FIG. 8, a zigzagging control method for a workpiece in a case where $\mu_{WM}$ and $\mu_{WB}$ are acquired through measurement, and $\phi_{WM}$ and $\phi_{WB}$ are acquired through estimation (Case 6) will be described. FIG. 6 is a flowchart illustrating the zigzagging control method for a workpiece in the case where $\mu_{WM}$ and $\mu_{WB}$ are acquired through measurement, and $\phi_{WM}$ and $\phi_{WB}$ are acquired through estimation (Case 6). FIG. 7 is an explanatory diagram illustrating an example of a method for measuring a friction coefficient. FIG. 8 is an explanatory diagram illustrating another example of the method for measuring a friction coefficient. Note that, in the following description, processes similar to those in Case 1 illustrated in FIG. 5 will not be described in detail.

In the present case, as illustrated in FIG. 6, first, before rolling of a tail portion of the workpiece is started, the estimation unit 110 performs processing for acquiring the inter-roll cross angle and the material-roll cross angle based on actual rolling results that include rolling loads, rolling reduction rates, and thrust counterforces acting on a roll other than the backup roll at two levels or more (S200). The rolling loads and the rolling reduction rates used may be either their actual values or their setting values. The thrust counterforces are measured values obtained by measurement at each level. The actual rolling results at two levels or more used in step S200 are stored in the actual rolling result database 200. From the actual rolling result database 200, the estimation unit 110 acquires two or more actual rolling results that have been acquired from at least any one of the upper and lower roll assemblies.

Here, the actual rolling results at two levels or more used for the estimation do not have to be data that has been acquired continuously on a time-series basis; it will suffice that the actual rolling results are those from any workpieces that have been rolled before a workpiece of which a tail portion is to pass later, as in Case 1 described above.

On the assumption that, while a workpiece that is continuous on a time-series basis passes, the friction coefficients and the cross angles in a stationary rolling state hardly change, the cross angles can be acquired with change over time taken into consideration by using actual rolling results acquired for two workpieces rolled recently in the estimation. In addition, the actual rolling results at two levels or more may be values that are acquired from different workpieces or may be actual rolling results at a plurality of levels acquired from the same workpieces. An accuracy of the acquired cross angle increases with an increase in the number of the levels.

In contrast, the inter-roll friction coefficient and the material-roll friction coefficient are acquired through measurement. The material-roll friction coefficient $\mu_{WM}$ can be acquired based on, for example, a technique described in JP4-284909A. In this technique, as illustrated in FIG. 7, an exit-side speed $V_0$ and a roll peripheral speed $V_R$ are measured in a roll stand upstream of a hot finish rolling mill in response to an on signal of a load cell from the roll stand, and a forward slip is acquired from a ratio between the exit-side speed $V_0$ and the roll peripheral speed $V_R$. The exit-side speed $V_0$ can be measured by an exit-side speed indicator 16*b* that is disposed on an exit side of the roll stand. Then, from the forward slip based on the measured values and an actual value of a rolling load p, a deformation resistance of a workpiece S and a friction coefficient $\mu_{WM}$ between a rolling roll and the workpiece are calculated.

It is commonly known that the inter-roll friction coefficient $\mu_{WB}$ depends on surface roughnesses of objects. Hence, for example, relationships between inter-roll friction coefficients $\mu_{WB}$ and surface roughnesses of the work rolls 1 and 2 and the backup rolls 3 and 4 are determined in advance before these rolls are built in, and these relationships are acquired in a form of a table. The table showing the relationships between the inter-roll friction coefficients $\mu_{WB}$ and the surface roughnesses of the work rolls 1 and 2 and the backup rolls 3 and 4 can be acquired by, for example, preparing test specimens that are made of the same starting materials as those of the work rolls 1 and 2 and the backup rolls 3 and 4 and have different surface roughnesses and measuring friction coefficients with a tribology tester or the like.

Then, after the rolls are built in, by measuring surface roughnesses of the work rolls 1 and 2 and the backup rolls 3 and 4 before rolling is started or another timing, and referring to the table acquired in advance, the inter-roll friction coefficient $\mu_{WB}$ can be estimated. Surface roughnesses $R_W$ and $R_B$ of the work rolls 1 and 2 and the backup rolls 3 and 4 can be measured by using, for example, a roughness gage provided for each roll, such as a work-roll roughness gage 17*b* illustrated in FIG. 8. By providing a sheet roughness gage 17*a*, which can measure a surface roughness $R_M$ of a workpiece S, the material-roll friction coefficient $\mu_{WM}$ can be similarly acquired.

Returning to the description of FIG. 6, the estimation unit 110 calculates at least any one of the material-roll thrust force $T_{WM}^B$ and the inter-roll thrust force $T_{WB}^B$ based on the inter-roll cross angle and the material-roll cross angle that are acquired as a result of the estimation in step S200, and the measured inter-roll friction coefficient and material-roll friction coefficient (S210). The material-roll thrust force $T_{WM}^B$ can be determined by, for example, the above Formula (5b), and the inter-roll thrust force $T_{WB}^B$ can be determined by, for example, the above Formula (6b). The processes up to step S210 are performed before the rolling of the tail portion of the workpiece is started.

Next, during the rolling of the tail portion of the workpiece, the tail control illustrated as the following steps S220 to S240 is performed. Processes of steps S220 to S240 are performed as with steps S120 to S140 illustrated in FIG. 5.

That is, first, the roll-axis-direction thrust counterforce acting on a roll other than a backup roll and the work-side and drive-side rolling loads are measured at the same time from the at least any one of the upper and lower roll assemblies (S220). Note that it will suffice to acquire the roll-axis-direction thrust counterforce and the work-side and drive-side rolling loads within a period in which tail control works effectively; they are not necessarily measured strictly at the same time. From the work-side and drive-side rolling loads, the differential-load thrust-counterforce acquisition unit 120 calculates a load difference or a load difference ratio.

Next, based on the measured roll-axis-direction thrust counterforce, and the inter-roll thrust force or the material-roll thrust force calculated by the estimation unit 110, the correction unit 130 corrects the rolling load difference or the rolling load difference ratio calculated based on the measured work-side and drive-side rolling loads (S230). Then, the rolling load difference is corrected by removing the calculated rolling load difference attributable to the thrust forces from the rolling load difference calculated based on the work-side and drive-side rolling loads measured in step S220. The correction applies similarly to a case of the rolling load difference ratio.

The leveling control unit 140 thereafter performs the reduction leveling control based on the rolling load difference or the rolling load difference ratio corrected by the correction unit 130 (S240). The leveling control unit 140 calculates controlled variables of the leveling devices 13*a* and 13*b* and drives leveling devices 13*a* and 13*b* based on the controlled variables.

As above, the zigzagging control method for a workpiece in the case where $\mu_{WM}$ and $\mu_{WB}$ are acquired through measurement, and $\phi_{WM}$ and $\phi_{WB}$ are acquired through estimation (Case 6) is described.

[3-4. Case Where $\mu_{WM}$ and $\mu_{WB}$ are Acquired Through Estimation, and $\phi_{WM}$ and $\phi_{WB}$ are Acquired Through Measurement (Case 11)]

Figure 9:
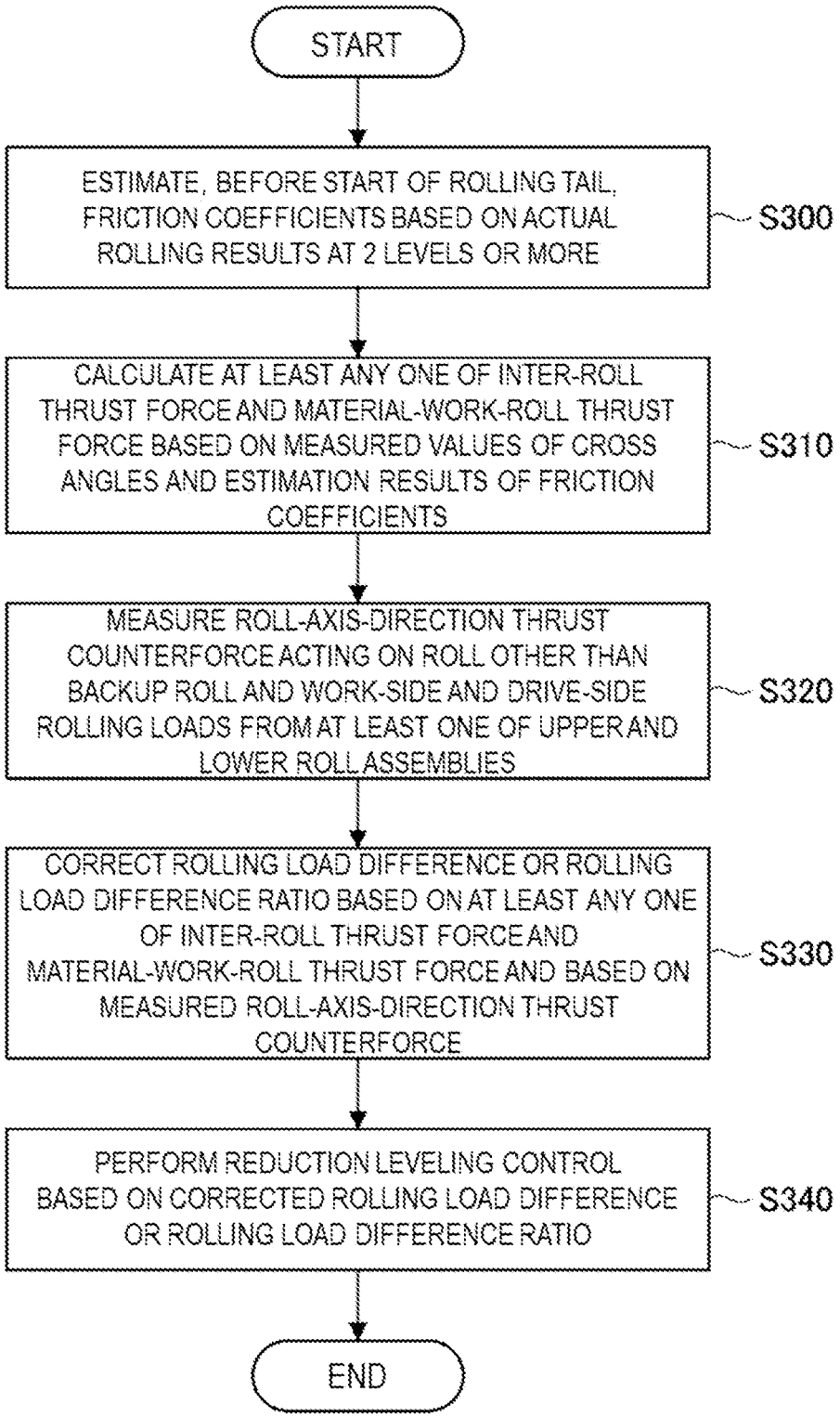
FIG. 9 is a flowchart illustrating a zigzagging control method for a workpiece in a case where $\mu_{WM}$ and $\mu_{WB}$ are acquired through estimation, and $\phi_{WM}$ and $\phi_{WB}$ are acquired through measurement (Case 11).
Figure 10:
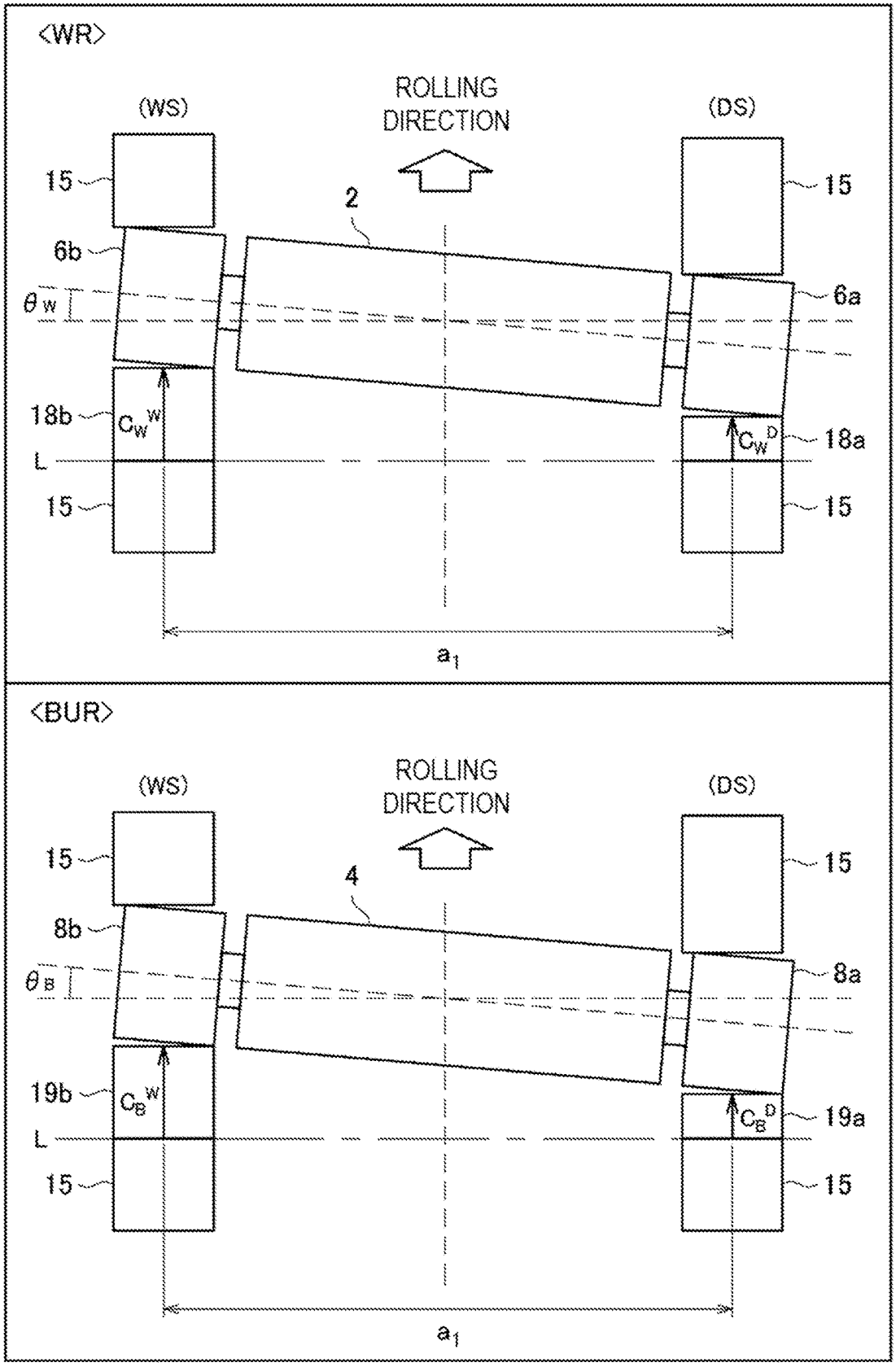
FIG. 10 is an explanatory diagram illustrating an example of a method for measuring a cross angle.

Next, with reference to FIG. 9 and FIG. 10, a zigzagging control method for a workpiece in a case where $\mu_{WM}$ and $\mu_{WB}$ are acquired through estimation, and $\phi_{WM}$ and $\phi_{WB}$ are acquired through measurement (Case 11) will be described. FIG. 9 is a flowchart illustrating the zigzagging control method for a workpiece in the case where $\mu_{WM}$ and $\mu_{WB}$ are acquired through estimation, and $\phi_{WM}$ and $\phi_{WB}$ are acquired through measurement (Case 11). FIG. 10 is an explanatory diagram illustrating an example of a method for measuring a cross angle. Note that, also in the following description, processes similar to those in Case 1 illustrated in FIG. 5 will not be described in detail.

In the present case, as illustrated in FIG. 9, first, before rolling of a tail portion of the workpiece is started, the estimation unit 110 performs processing for acquiring the inter-roll friction coefficient and the material-roll friction coefficient based on actual rolling results that include rolling loads, rolling reduction rates, and thrust counterforces acting on a roll other than the backup roll at two levels or more (S300). The rolling loads and the rolling reduction rates used may be either their actual values or their setting values. The thrust counterforces are measured values obtained by measurement at each level. The actual rolling results at two levels or more used in step S300 are stored in the actual rolling result database 200. From the actual rolling result database 200, the estimation unit 110 acquires two or more actual rolling results that have been acquired from at least any one of the upper and lower roll assemblies.

Here, the actual rolling results at two levels or more used for the estimation do not have to be data that has been acquired continuously on a time-series basis; it will suffice that the actual rolling results are those from any workpieces that have been rolled before a workpiece of which a tail portion is to pass later, as in Case 1 described above. On the assumption that, while a workpiece that is continuous on a time-series basis passes, the friction coefficients and the cross angles in a stationary rolling state hardly change, the friction coefficients can be acquired with change over time taken into consideration by using actual rolling results acquired for two workpieces rolled recently in the estimation. In addition, the actual rolling results at two levels or more may be values that are acquired from different workpieces or may be actual rolling results at a plurality of levels acquired from the same workpieces. An accuracy of the acquired friction coefficient increases with an increase in the number of the levels.

In contrast, the inter-roll cross angle $\phi_{WB}$ and the material-roll cross angle $\phi_{WM}$ are acquired through measurement. For example, in a case where devices that can apply rolling-direction external forces to between chocks and the housing, the cross angle can be determined from a difference between their cylinder positions on the work side (WS) and the drive side (DS). Here, consider cross angles $\theta_W$ and $\theta_B$ of the lower work roll 2 and the lower backup roll 4 in the lower roll assembly with reference to FIG. 10. The lower work roll 2 is supported by the lower work roll chocks 6*a* and 6*b* at its drive side and work side. The lower work roll chocks 6*a* and 6*b* are pressed against the housing 15 by rolling-direction external-force applying devices 18*a* and 18*b*. The lower backup roll chocks 8*a* and 8*b* are pressed against the housing 15 by rolling-direction external-force applying devices 19*a* and 19*b*. Note that the same holds true for the upper roll assembly.

As illustrated in FIG. 10, let $C_W^W$ denote a cylinder position of a work roll (WR) on the work side (WS) and $C_W^D$ denote a cylinder position of the work roll (WR) on the drive side (DS). Similarly, let $C_B^W$ denote a cylinder position of a backup roll (BUR) on the work side (WS) and $C_B^D$ denote a cylinder position of the backup roll (BUR) on the drive side (DS). In addition, let $a_1$ denote an inter-chock distance. At this time, the cross angle $\theta_W$ of the lower work roll 2 and the cross angle $\theta_B$ of the lower backup roll 4 are expressed by the following Formulas (8) and (9).

[Expression 12]

$$\theta_W = \tan^{-1}\left(\frac{C_W^W - C_W^D}{a_1}\right) \tag{8}$$

$$\theta_B = \tan^{-1}\left(\frac{C_B^W - C_B^D}{a_1}\right) \tag{9}$$

From the above Formulas (8) and (9), the material-roll cross angle $\phi_{WM}$ and the inter-roll cross angle $\phi_{WB}$ are expressed by the following Formulas (10) and (11).

[Expression 13]

$$\phi_{WM} = \theta_W = \tan^{-1}\left(\frac{C_W^W - C_W^D}{a_1}\right) \tag{10}$$

$$\phi_{WB} = \theta_B - \theta_W = \tan^{-1}\left(\frac{C_B^W - C_B^D}{a_1}\right) - \tan^{-1}\left(\frac{C_W^W - C_W^D}{a_1}\right) \tag{11}$$

Returning to the description of FIG. 9, the estimation unit 110 calculates at least any one of the material-roll thrust force $T_{WM}^B$ and the inter-roll thrust force $T_{WB}^B$ based on the inter-roll friction coefficient and the material-roll friction coefficient that are acquired as a result of the estimation in step S300, and the measured inter-roll cross angle and material-roll cross angle (S310). The material-roll thrust force $T_{WM}^B$ can be determined by, for example, the above Formula (5c), and the inter-roll thrust force $T_{WB}^B$ can be determined by, for example, the above Formula (6c). The processes up to step S310 are performed before the rolling of the tail portion of the workpiece is started.

Next, during the rolling of the tail portion of the workpiece, the tail control illustrated as the following steps S320 to S340 is performed. Processes of steps S320 to S340 are performed as with steps S120 to S140 illustrated in FIG. 5.

That is, first, the roll-axis-direction thrust counterforce acting on a roll other than a backup roll and the work-side and drive-side rolling loads are measured at the same time from the at least any one of the upper and lower roll assemblies (S320). Note that it will suffice to acquire the roll-axis-direction thrust counterforce and the work-side and drive-side rolling loads within a period in which tail control works effectively; they are not necessarily measured strictly at the same time. From the work-side and drive-side rolling loads, the differential-load thrust-counterforce acquisition unit 120 calculates a load difference or a load difference ratio.

Next, based on the measured roll-axis-direction thrust counterforce, and the inter-roll thrust force or the material-roll thrust force calculated by the estimation unit 110, the correction unit 130 corrects the rolling load difference or the rolling load difference ratio calculated based on the measured work-side and drive-side rolling loads (S330). Then, the rolling load difference is corrected by removing the calculated rolling load difference attributable to the thrust forces from the rolling load difference calculated based on the work-side and drive-side rolling loads measured in step S320. The correction applies similarly to a case of the rolling load difference ratio.

The leveling control unit 140 thereafter performs the reduction leveling control based on the rolling load difference or the rolling load difference ratio corrected by the correction unit 130 (S340). The leveling control unit 140 calculates controlled variables of the leveling devices 13*a* and 13*b* and drives leveling devices 13*a* and 13*b* based on the controlled variables.

As above, the zigzagging control method for a workpiece in the case where $\mu_{WM}$ and $\mu_{WB}$ are acquired through estimation, and $\phi_{WM}$ and $\phi_{WB}$ are acquired through measurement (Case 11) is described.

[3-5. Case Where $\mu_{WM}$, $\mu_{WB}$, $\phi_{WM}$, and $\phi_{WB}$ are All Acquired Through Measurement (Case 16)]

Figure 11:
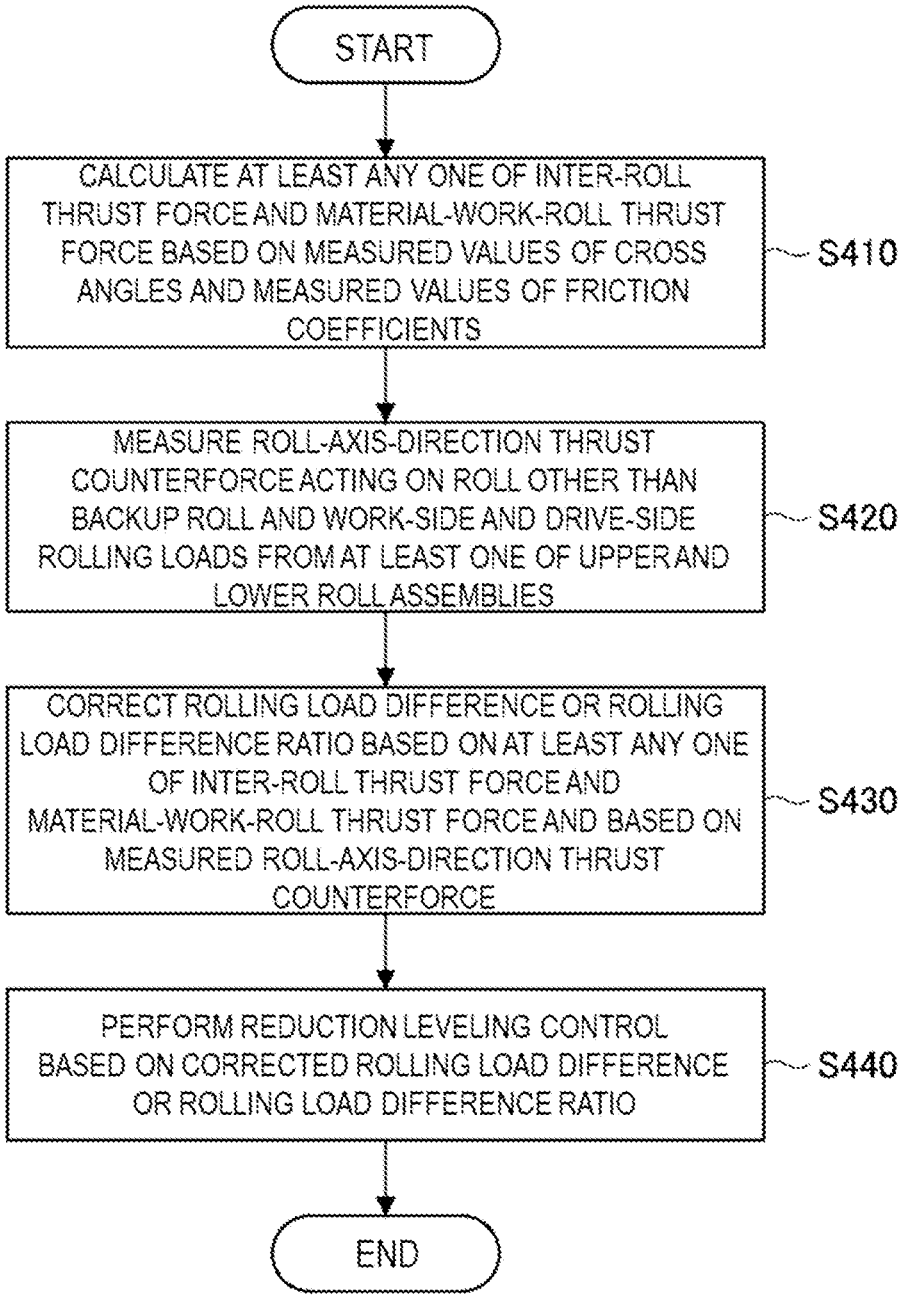
FIG. 11 is a flowchart illustrating a zigzagging control method for a workpiece in a case where $\mu_{WM}$, $\mu_{WB}$, $\phi_{WM}$, and $\phi_{WB}$ are all acquired through measurement (Case 16).

Next, with reference to FIG. 11, a zigzagging control method for a workpiece in a case where $\mu_{WM}$, $\mu_{WB}$, $\phi_{WM}$, and $\phi_{WB}$ are all acquired through measurement (Case 16) will be described. FIG. 11 is a flowchart illustrating the zigzagging control method for a workpiece in a case where $\mu_{WM}$, $\mu_{WB}$, $\phi_{WM}$, and $\phi_{WB}$ are all acquired through measurement (Case 16). Note that, also in the following description, processes similar to those in Case 1 illustrated in FIG. 5 will not be described in detail.

In the present case, the inter-roll friction coefficient, the material-roll friction coefficient, the inter-roll cross angle, and the material-roll cross angle are acquired through measurement. The inter-roll friction coefficient and the material-roll friction coefficient are to be acquired through measurement by the technique illustrated in FIG. 7 and FIG. 8. The inter-roll cross angle and the material-roll cross angle are to be acquired through measurement by the technique illustrated in FIG. 10.

The estimation unit 110 calculates at least any one of the material-roll thrust force $T_{WM}^{B}$ and the inter-roll thrust force $T_{WB}^{B}$ based on the inter-roll friction coefficient, the material-roll friction coefficient, the inter-roll cross angle, and the material-roll cross angle that are acquired through measurement (S410). The material-roll thrust force $T_{WM}^{B}$ can be determined by, for example, the above Formula (5d), and the inter-roll thrust force $T_{WB}^{B}$ can be determined by, for example, the above Formula (6d). The process of step S410 are performed before the rolling of the tail portion of the workpiece is started.

Next, during the rolling of the tail portion of the workpiece, the tail control illustrated as the following steps S420 to S440 is performed. Processes of steps S420 to S440 are performed as with steps S120 to S140 illustrated in FIG. 5.

That is, first, the roll-axis-direction thrust counterforce acting on a roll other than a backup roll and the work-side and drive-side rolling loads are measured at the same time from the at least any one of the upper and lower roll assemblies (S420). Note that it will suffice to acquire the roll-axis-direction thrust counterforce and the work-side and drive-side rolling loads within a period in which tail control works effectively; they are not necessarily measured strictly at the same time. From the work-side and drive-side rolling loads, the differential-load thrust-counterforce acquisition unit 120 calculates a load difference or a load difference ratio.

Next, based on the measured roll-axis-direction thrust counterforce, and the inter-roll thrust force or the material-roll thrust force calculated by the estimation unit 110, the correction unit 130 corrects the rolling load difference or the rolling load difference ratio calculated based on the measured work-side and drive-side rolling loads (S430). Then, the rolling load difference is corrected by removing the calculated rolling load difference attributable to the thrust forces from the rolling load difference calculated based on the work-side and drive-side rolling loads measured in step S420. The correction applies similarly to a case of the rolling load difference ratio.

The leveling control unit 140 thereafter performs the reduction leveling control based on the rolling load difference or the rolling load difference ratio corrected by the correction unit 130 (S440). The leveling control unit 140 calculates controlled variables of the leveling devices 13*a* and 13*b* and drives leveling devices 13*a* and 13*b* based on the controlled variables.

As above, the zigzagging control method for a workpiece in the case where $\mu_{WM}$, $\mu_{WB}$, $\phi_{WM}$, and $\phi_{WB}$ are all acquired through measurement (Case 16) is described. Note that the zigzagging control for a workpiece can be performed in a manner as described above also for the cases other than Cases 1, 6, 11, and 16 shown in Table 1.

According to the present embodiment, the zigzagging control is performed on a workpiece with the material-roll thrust force or the inter-roll thrust force taken into consideration and with influence of a cross angle (e.g., change over time due to wearing away of a liner) and influence of a friction coefficient (e.g., change over time due to wearing away or surface deterioration of a roll) taken into consideration. This enables leveling correction to be performed with influence of the thrust forces taken into consideration more accurately, and thus the centerline deviation can be reduced. In addition, the zigzagging control method for a workpiece according to the present embodiment can be implemented simply because there is no need to install measurement equipment on a line.

[4. Update of Cross Angles and Friction Coefficients]

In the zigzagging control method for a workpiece described above, the cross angles or the friction coefficients are acquired through estimation before a tail portion of the workpiece is rolled, except Case 16 shown in Table 1. Here, by learning behavior of the variations of learned values of the cross angles and the friction coefficients since rolls are changed until the rolls are replaced, a learning model for the cross angles and the friction coefficients with higher accuracy can be created.

For example, in a case where $\mu_{WM}$, $\mu_{WB}$, $\phi_{WM}$, and $\phi_{WB}$ are all acquired through estimation as in Case 1 shown in Table 1, the estimation unit 110 calculates, in step S100 illustrated in FIG. 5, an inter-roll cross angle, a material-roll cross angle, an inter-roll friction coefficient, and a material-roll friction coefficient in current rolling based on predicted values of variations of an inter-roll cross angle, a material-roll cross angle, an inter-roll friction coefficient, and a material-roll friction coefficient of each workpiece that are calculated based on a result of past learning, and based on a result of learning an inter-roll cross angle, a material-roll cross angle, an inter-roll friction coefficient, and a material-roll friction coefficient in last rolling.

For example, as shown in the following Table 2, consider a case where a result of learning cross angles and friction coefficients of a first workpiece up to an ith workpiece has been acquired, and a cross angle and a friction coefficient of an (i+1)th workpiece (workpiece in question) are to be estimated.

TABLE 2

| calculation items | workpiece 1st | . . . | (i − 1)th | ith | (i + 1)th (workpiece in question) |
|---|---|---|---|---|---|
| material-roll friction coefficient $\mu_{WM}$ | $\mu_{WM}^{1}$ | . . . | $\mu_{WM}^{i-1}$ | $\mu_{WM}^{i}$ | acquire by estimation |
| inter-roll friction coefficient $\mu_{WB}$ | $\mu_{WB}^{1}$ | . . . | $\mu_{WB}^{i-1}$ | $\mu_{WB}^{i}$ | acquire by estimation |
| material-roll cross angle $\phi_{WM}$ | $\phi_{WM}^{1}$ | . . . | $\phi_{WM}^{i-1}$ | $\phi_{WM}^{i}$ | acquire by estimation |
| inter-roll cross angle $\phi_{WB}$ | $\phi_{WB}^{1}$ | . . . | $\phi_{WB}^{i-1}$ | $\phi_{WB}^{i}$ | acquire by estimation |

At this time, for example, by using the predicted values of the variations of each workpiece, cross angles ($\phi_{WM}^{i+1}$, $\phi_{WB}^{i+1}$) and friction coefficient ($\mu_{WM}^{i+1}$, $\mu_{WB}^{i+1}$) of an (i+1) th workpiece can be predicted from the following Formulas (12-1) to (12-4). The predicted values of the variations are each expressed as a difference in cross angle or friction coefficient between the ith workpiece and the (i−1)th workpiece. For example, in Formula (12-1), ($\mu_{WM}^{i}-\mu_{WM}^{i-1}$) expresses a predicted value of a variation.

[Expression 14]

$$\mu_{WM}^{i+1}=\mu_{WM}^{i}+(\mu_{WM}^{i}-\mu_{WM}^{i-1}) \quad (12\text{-}1)$$

$$\mu_{WB}^{i+1}=\mu_{WB}^{i}+(\mu_{WB}^{i}-\mu_{WB}^{i-1}) \quad (12\text{-}2)$$

$$\phi_{WM}^{i+1}=\phi_{WM}^{i}+(\phi_{WM}^{i}-\phi_{WM}^{i-1}) \quad (12\text{-}3)$$

$$\phi_{WB}^{i+1}=\phi_{WM}^{i}+(\phi_{WB}^{i}-\phi_{WB}^{i-1}) \quad (12\text{-}4)$$

Note that, in the cases other than Case 1 shown in Table 1, values that are acquired through measurement are to be excluded from values to be updated. For example, in Case 6, where $\mu_{WM}$ and $\mu_{WB}$ are acquired through measurement, and $\phi_{WM}$ and $\phi_{WB}$ are acquired through estimation, the inter-roll cross angle $\phi_{WB}$ and the material-roll cross angle $\phi_{WM}$ are to be updated. In Case 11, where $\mu_{WM}$ and $\mu_{WB}$ are acquired through estimation, and $\phi_{WM}$ and $\phi_{WB}$ are acquired through measurement, the inter-roll friction coefficient $\mu_{WB}$ and the material-roll friction coefficient $\mu_{WM}$ are to be updated. In Case 16, however, this processing is not performed because the inter-roll friction coefficient, the material-roll friction coefficient, the inter-roll cross angle, and the material-roll cross angle are all acquired through measurement.

Learning cross angles and friction coefficients in this manner dispenses with a necessity to learn a cross angle and a friction coefficient of the workpiece in question in real time, which can reduce an on-line computational load. Note that items to be learned are not limited to values that are acquired through estimation. In a case where the reduction in the on-line computational load is an objective of the learning processing for cross angles and friction coefficients, the values to be updated are as described above; however, for example, in a case where consideration is given to measures against a sudden anomaly in the measurement apparatuses, the learning of the behavior of the variations may be performed on items that are acquired through measurement.

In addition, estimated values, which are acquired through estimation out of the inter-roll cross angle, the material-roll cross angle, the inter-roll friction coefficient, and the material-roll friction coefficient, may be corrected in accordance with a difference between an estimated value based on data on constant portions of workpieces rolled in a past and an estimated value based on data on tail portions of the workpieces. For example, the material-roll friction coefficient can differ between a constant portion and a tail portion of a workpiece due to influence of scales produced during rolling and the like. For that reason, an estimated value determined based on data on constant portions of workpieces can be an inappropriate value for a tail portion of a workpiece to be actually subjected to the zigzagging control. Hence, the learning may be performed based on the difference between the estimated value based on the data on constant portions of the workpieces rolled in a past and the estimated value based on the data on the tail portions of the workpieces, and an estimated value for the workpiece in question may be calculated with the difference taken into consideration.

Note that, in a case of, for example, a rolling mill including a plurality of roll stands such as a hot finish rolling mill, a tail portion of a workpiece refers to a portion that passes a stand in question since a tail passes a previous stand until the tail passes the stand in question. A constant portion of a workpiece refers to a portion of the workpiece excluding a leading portion and a tail portion and having a constant shape. For example, for a stand other than a final stand, a constant portion of a workpiece may be considered to be a portion of the workpiece that passes the stand since a front edge of the workpiece is gripped by a next stand until a tail portion of the workpiece passes a previous stand. For the final stand, a constant portion of a workpiece may be considered to be a portion of the workpiece equivalent to a constant portion for a previous stand.

EXAMPLE

In order to verify the effects of the zigzagging control method for a workpiece according to the present invention, a simulation of reduction leveling control on a workpiece was conducted. Conditions for the simulation were specified as follows. The simulation was conducted under the following conditions specified for a small test rolling mill, with consideration given to a wedge (30 μm) and a lateral difference in deformation resistance (35 kg/mm) as disturbances other than the thrust forces.

(Conditions for Simulation)

Work roll diameter: 295.2 mm

Backup roll diameter: 714.0 mm

Rolling load: 400 tonf

Rolling reduction rate: 30%

Entrance side sheet thickness: 5 mm

Sheet width: 400 mm

Rolling speed: 50 mpm

Material-roll friction coefficient $\mu_{WM}$: 0.25

Inter-roll friction coefficient $\mu_{WB}$: 0.1

Material-roll cross angle $\phi_{WM}$: 0.03°

Inter-roll cross angle $\phi_{WB}$: 0.03°

As Examples 1 to 4, simulations of rolling a workpiece by the zigzagging control method according to the present invention were conducted. Example 1 simulated Case 1 shown in Table 1; the thrust forces were determined by estimating the cross angles and the friction coefficients, a rolling load difference acquired from measured values was corrected with a rolling load difference attributable to the thrust forces, and the reduction leveling control was performed. Example 2 simulated Case 6 shown in Table 1; the thrust forces were determined by acquiring the cross angles through estimation and acquiring the friction coefficients through measurement, a rolling load difference acquired from measured values was corrected with a rolling load difference attributable to the thrust forces, and the reduction leveling control was performed. Example 3 simulated Case 11 shown in Table 1; the thrust forces were determined by acquiring the friction coefficients through estimation and acquiring the cross angles through measurement, a rolling load difference acquired from measured values was corrected with a rolling load difference attributable to the thrust forces, and the reduction leveling control was performed. Example 4 simulated Case 16 shown in Table 1; the thrust forces were determined by measuring the cross angles and the friction coefficients, a rolling load difference acquired from measured values was corrected with a rolling load difference attributable to the thrust forces, and the reduction leveling control was performed.

In Examples 2 to 4, a measurement error was taken into consideration; the measurement error was assumed to be 1%. In Example 2, the material-roll friction coefficient $\mu_{WM}$ was assumed to be 0.2525, and the inter-roll friction coefficient $\mu_{WB}$ was assumed to be 0.101. In Example 3, the material-roll cross angle $\phi_{WM}$ was assumed to be 0.0303°, and the inter-roll cross angle $\phi_{WB}$ was assumed to be 0.0303°. In Example 4, the material-roll friction coefficient $\mu_{WM}$ was assumed to be 0.2525, the inter-roll friction coefficient $\mu_{WB}$ was assumed to be 0.101, the material-roll cross angle $\phi_{WM}$ was assumed to be 0.0303°, and the inter-roll cross angle $\phi_{WB}$ was assumed to be 0.0303°.

In contrast, in Comparative example 1, the thrust forces are determined by acquiring only the cross angles, a rolling load difference acquired from measured values is corrected with a rolling load difference attributable to the thrust forces, and the reduction leveling control was performed. In Comparative example 2, the thrust forces were determined by acquiring only the friction coefficients, a rolling load difference acquired from measured values was corrected with a rolling load difference attributable to the thrust forces, and the reduction leveling control was performed. In Comparative example 3, although the thrust forces were taken into consideration, the cross angles and the friction coefficients were not acquired, a rolling load difference acquired from measured values was corrected with a rolling load difference attributable to the thrust forces, and the reduction leveling control was performed. In Comparative example 4, the reduction leveling control was performed with the thrust forces not taken into consideration at all.

In Comparative example 1, the material-roll friction coefficient $\mu_{WM}$ was assumed to be 0.3, and the inter-roll friction coefficient $\mu_{WB}$ was assumed to be 0.15. In Comparative example 2, the material-roll cross angle $\phi_{WM}$ was assumed to be 0.031°, and the inter-roll cross angle $\phi_{WB}$ was assumed to be 0.031°. In Comparative example 3, the material-roll friction coefficient $\mu_{WM}$ was assumed to be 0.3, the inter-roll friction coefficient $\mu_{WB}$ was assumed to be 0.15, the material-roll cross angle $\phi_{WM}$ was assumed to be 0.031°, and the inter-roll cross angle $\phi_{WB}$ was assumed to be 0.031°.

Methods of Example 1 and Comparative examples 1 to 4 were evaluated in terms of centerline deviation. As the centerline deviation, a centerline deviation at a time 3 seconds later from occurrence of the thrust forces was used. Results of the simulations are shown in Table 3.

TABLE 3

| | | thrust force estimation | | load difference attributable | estimated value of load difference attributable | correction error in differential load attributable | |
|---|---|---|---|---|---|---|---|
| | thrust force consideration | cross angle acquirement | friction coefficient acquirement | to thrust force (A) [tonf] | to thrust force (B) [tonf] | to thrust force (A − B) [tonf] | centerline deviation [mm] |
| Example 1 | presence | presence (estimation) | presence (estimation) | 10.30 | 10.30 | 0.00 | 12.40 |
| Example 2 | presence | presence (estimation) | presence (measurement) | 10.30 | 10.31 | 0.01 | 12.56 |
| Example 3 | presence | presence (measurement) | presence (estimation) | 10.30 | 10.40 | 0.09 | 13.77 |
| Example 4 | presence | presence (measurement) | presence (measurement) | 10.30 | 10.41 | 0.11 | 14.07 |
| Comparative example 1 | presence | presence | absence | 10.30 | 10.63 | 0.33 | 17.40 |
| Comparative example 2 | presence | absence | presence | 10.30 | 10.61 | 0.31 | 17.10 |
| Comparative example 3 | presence | absence | absence | 10.30 | 10.96 | 0.66 | 22.39 |
| Comparative example 4 | absence | — | — | 10.30 | 0.00 | 10.30 | 168.27 |

As seen from Table 3, Examples 1 to 4 succeeded in decreasing a correction error in a differential load attributable to the thrust forces and most succeeded in reducing centerline deviations, as compared with Comparative examples 1 to 4. This demonstrates that using the zigzagging control method for a workpiece according to the present invention enables the leveling correction to be performed with influence of the thrust forces taken into consideration more accurately, and thus the centerline deviation of the workpiece can be reduced.

A preferred embodiment of the present invention is described above in detail with reference to the accompanying drawings, but the present invention is not limited to the above examples. It is apparent that a person skilled in the art may conceive various alterations and modifications within technical concepts described in the appended claims, and it should be appreciated that they will naturally come under the technical scope of the present invention.

For example, the present embodiment is described about a zigzagging control method for a workpiece in a four-high rolling mill; however, the present invention is not limited to this example. For example, the present invention is also applicable to a six-high rolling mill.

REFERENCE SIGNS LIST

1 upper work roll
2 lower work roll
3 upper backup roll
4 lower backup roll
5*a* upper work roll chock (drive side)
5*b* upper work roll chock (work side)
6*a* lower work roll chock (drive side)
6*b* lower work roll chock (work side)
7*a* upper backup roll chock (drive side)
7*b* upper backup roll chock (work side)
8*a* lower backup roll chock (drive side)
8*b* lower backup roll chock (work side)
10 rolling mill
11*a* lower load sensor (drive side)
11*b* lower load sensor (work side)
12*a* thrust counterforce measurement apparatus (drive side)
12*b* thrust counterforce measurement apparatus (work side)
13*a* leveling device (drive side)
13*b* leveling device (work side)
14*a* work roll shift device (drive side)
14*b* work roll shift device (work side)
15 housing
16*b* exit-side speed indicator
17*a* sheet roughness gage
17*b* work-roll roughness gage
18*a* rolling-direction external-force applying device (work-roll drive side)
18*b* rolling-direction external-force applying device (work-roll work side)
19*a* rolling-direction external-force applying device (backup-roll drive side)
19*b* rolling-direction external-force applying device (backup-roll work side)
110 estimation unit
120 differential-load thrust-counterforce acquisition unit
130 correction unit
140 leveling control unit
200 actual rolling result database

The invention claimed is:

1. A zigzagging control method for a workpiece in a rolling mill of four-high or more, the rolling mill including a plurality of rolls that include at least a pair of work rolls including an upper work roll and a lower work roll and at least a pair of backup rolls including an upper backup roll and a lower backup roll supporting the work rolls, an upper roll assembly including the upper work roll and the upper backup roll, a lower roll assembly including the lower work roll and the lower backup roll, the zigzagging control method comprising:

an estimation step of acquiring at least any one of an inter-roll thrust force estimated based on an inter-roll cross angle and an inter-roll friction coefficient that are acquired through measurement or estimation and a material-roll thrust force estimated based on a material-roll cross angle and a material-roll friction coefficient that are acquired through measurement or estimation, the estimation step being performed before rolling of a tail portion of the workpiece; and a tail control step of measuring work-side and drive-side rolling loads of at least any one of the upper and lower roll assemblies, correcting rolling-load-difference information based on any two of acquired parameters including a roll-axis-direction thrust counterforce at the measurement of the rolling loads, the inter-roll thrust force, and the material-roll thrust force that act on a roll other than the backup roll, the rolling-load-difference information being calculated based on the measured work-side and drive-side rolling loads, and performing reduction leveling control on the rolling mill based on the corrected rolling-load-difference information, the tail control step being performed during the rolling of the tail portion of the workpiece.

2. The zigzagging control method for the workpiece according to claim 1, wherein in the tail control step, the rolling-load-difference information is corrected based on the roll-axis-direction thrust counterforce measured at the measurement of the rolling loads and the inter-roll thrust force or the material-roll thrust force acquired in the estimation step.

3. The zigzagging control method for the workpiece according to claim 2, wherein in the estimation step, the inter-roll cross angle, the material-roll cross angle, the inter-roll friction coefficient, and the material-roll friction coefficient are acquired through estimation based on rolling loads, rolling reduction rates, and thrust counterforces acting on a roll other than the backup roll at four levels or more acquired from at least any one of the upper and lower roll assemblies, and at least one of the inter-roll thrust force and the material-roll thrust force is acquired through estimation based on the acquired inter-roll cross angle, material-roll cross angle, inter-roll friction coefficient, and material-roll friction coefficient.

4. The zigzagging control method for the workpiece according to claim 3, wherein in the estimation step, estimated values, which are acquired through estimation out of the inter-roll cross angle, the material-roll cross angle, the inter-roll friction coefficient, and the material-roll friction coefficient, are acquired in accordance with predicted values of variations of the estimated values of each workpiece estimated based on a result of past learning and a result of estimating estimated values in last rolling.

5. The zigzagging control method for the workpiece according to claim 3, wherein in the estimation step, estimated values, which are acquired through estimation out of the inter-roll cross angle, the material-roll cross angle, the inter-roll friction coefficient, and the material-roll friction coefficient, are corrected in accordance with a difference between an estimated value based on data on constant portions of workpieces rolled in a past and an estimated value based on data on tail portions of the workpieces.

6. The zigzagging control method for the workpiece according to claim 3, wherein in the estimation step, rolling loads, rolling reduction rates, and thrust counterforces acting on a roll other than the backup roll for workpieces rolled recently are used.

7. The zigzagging control method for the workpiece according to claim 1, wherein in the estimation step, the inter-roll cross angle, the material-roll cross angle, the inter-roll friction coefficient, and the material-roll friction coefficient are acquired through estimation based on rolling loads, rolling reduction rates, and thrust counterforces acting on a roll other than the backup roll at four levels or more acquired from at least any one of the upper and lower roll assemblies, and at least one of the inter-roll thrust force and the material-roll thrust force is acquired through estimation based on the acquired inter-roll cross angle, material-roll cross angle, inter-roll friction coefficient, and material-roll friction coefficient.

8. The zigzagging control method for the workpiece according to claim 7, wherein in the estimation step, estimated values, which are acquired through estimation out of the inter-roll cross angle, the material-roll cross angle, the inter-roll friction coefficient, and the material-roll friction coefficient, are acquired in accordance with predicted values of variations of the estimated values of each workpiece estimated based on a result of past learning and a result of estimating estimated values in last rolling.

9. The zigzagging control method for the workpiece according to claim 7, wherein in the estimation step, estimated values, which are acquired through estimation out of the inter-roll cross angle, the material-roll cross angle, the inter-roll friction coefficient, and the material-roll friction coefficient, are corrected in accordance with a difference between an estimated value based on data on constant portions of workpieces rolled in a past and an estimated value based on data on tail portions of the workpieces.

10. The zigzagging control method for the workpiece according to claim 7, wherein in the estimation step, rolling loads, rolling reduction rates, and thrust counterforces acting on a roll other than the backup roll for workpieces rolled recently are used.

11. The zigzagging control method for the workpiece according to claim 1, wherein in the estimation step, an inter-roll friction coefficient and a material-roll friction coefficient are acquired through measurement, and an inter-roll cross angle and a material-roll cross angle are acquired through estimation based on rolling loads, rolling reduction rates, and thrust counterforces acting on a roll other than the backup roll at two levels or more acquired from at least any one of the upper and lower roll assemblies, and at least one of the inter-roll thrust force and the material-roll thrust force is acquired through estimation based on the acquired inter-roll cross angle, material-roll cross angle, inter-roll friction coefficient, and material-roll friction coefficient.

12. The zigzagging control method for the workpiece according to claim 1, wherein in the estimation step, an inter-roll cross angle and a material-roll cross angle are acquired through measurement, and an inter-roll friction coefficient and a material-roll friction coefficient are acquired through estimation based on rolling loads, rolling reduction rates, and thrust counterforces acting on a roll other than the backup roll at two levels or more acquired from at least any one of the upper and lower roll assemblies, and at least one of the inter-roll thrust force and the material-roll thrust force is acquired through estimation based on the acquired inter-roll cross angle, material-roll cross angle, inter-roll friction coefficient, and material-roll friction coefficient.

13. The zigzagging control method for the workpiece according to claim 1, wherein in the estimation step, estimated values, which are acquired through estimation out of the inter-roll cross angle, the material-roll cross angle, the inter-roll friction coefficient, and the material-roll friction coefficient, are acquired in accordance with predicted values of variations of the estimated values of each workpiece estimated based on a result of past learning and a result of estimating estimated values in last rolling.

14. The zigzagging control method for the workpiece according to claim 13, wherein in the estimation step, estimated values, which are acquired through estimation out of the inter-roll cross angle, the material-roll cross angle, the inter-roll friction coefficient, and the material-roll friction coefficient, are corrected in accordance with a difference between an estimated value based on data on constant portions of workpieces rolled in a past and an estimated value based on data on tail portions of the workpieces.

15. The zigzagging control method for the workpiece according to claim 14, wherein in the estimation step, rolling loads, rolling reduction rates, and thrust counterforces acting on a roll other than the backup roll for workpieces rolled recently are used.

16. The zigzagging control method for the workpiece according to claim 13, wherein in the estimation step, rolling loads, rolling reduction rates, and thrust counterforces acting on a roll other than the backup roll for workpieces rolled recently are used.

17. The zigzagging control method for the workpiece according to claim 1, wherein in the estimation step, estimated values, which are acquired through estimation out of the inter-roll cross angle, the material-roll cross angle, the inter-roll friction coefficient, and the material-roll friction coefficient, are corrected in accordance with a difference between an estimated value based on data on constant portions of workpieces rolled in a past and an estimated value based on data on tail portions of the workpieces.

18. The zigzagging control method for the workpiece according to claim 17, wherein in the estimation step, rolling loads, rolling reduction rates, and thrust counterforces acting on a roll other than the backup roll for workpieces rolled recently are used.

19. The zigzagging control method for the workpiece according to claim 1, wherein in the estimation step, rolling loads, rolling reduction rates, and thrust counterforces acting on a roll other than the backup roll for workpieces rolled recently are used.

20. The zigzagging control method for the workpiece according to claim 1, wherein in the estimation step, the inter-roll friction coefficient, the material-roll friction coefficient, the inter-roll cross angle, and the material-roll cross angle are acquired through measurement, and at least any one of the inter-roll thrust force and the material-roll thrust force is acquired through estimation based on the acquired inter-roll cross angle, material-roll cross angle, inter-roll friction coefficient, and material-roll friction coefficient.

* * * * *